US005344750A

United States Patent [19]

Fujimoto et al.

[11] Patent Number: 5,344,750

[45] Date of Patent: Sep. 6, 1994

[54] COLOR DEVELOPMENT PROCESSING METHOD OF SILVER HALIDE COLOR PHOTOGRAPHIC MATERIAL USING A COLOR DEVELOPER WHERE THE COLOR DEVELOPING AGENT CONCENTRATION AND PROCESSING TEMPERATURE ARE A FUNCTION OF BROMIDE ION CONCENTRATION

[75] Inventors: Hiroshi Fujimoto; Masato Taniguchi, both of Kanagawa, Japan

[73] Assignee: Fuji Photo Film Co., Ltd., Kanagawa, Japan

[21] Appl. No.: 59,262

[22] Filed: May 11, 1993

[30] Foreign Application Priority Data

May 12, 1992 [JP] Japan ..... 4-145063
May 18, 1992 [JP] Japan ..... 4-124842

[51] Int. Cl.[5] ..... G03C 5/00; G03C 5/18; G03C 5/26

[52] U.S. Cl. ..... 430/434; 430/30; 430/484; 430/485; 430/487; 430/467; 430/469; 430/489; 430/493; 430/963

[58] Field of Search ..... 430/30, 467, 469, 484, 430/489, 485, 493, 487, 399, 963, 434

[56] References Cited

U.S. PATENT DOCUMENTS

| | | | |
|---|---|---|---|
| 2,950,970 | 8/1960 | Schwan et al. | 430/493 |
| 2,956,876 | 10/1960 | Spath | 430/489 |
| 3,201,242 | 8/1965 | Schwan et al. | 430/487 |
| 4,276,374 | 6/1981 | Mifune et al. | 430/489 |
| 4,348,475 | 9/1982 | Wernicke et al. | 430/399 |
| 4,801,516 | 1/1989 | Ishikawa et al. | 430/489 |
| 4,897,339 | 1/1990 | Andoh et al. | 430/489 |
| 4,997,749 | 3/1991 | Wernicke et al. | 430/434 |
| 5,100,765 | 3/1992 | Fujimoto | 430/434 |
| 5,176,987 | 1/1993 | Nakamura et al. | 430/467 |
| 5,200,302 | 4/1993 | Iwano | 430/403 |

*Primary Examiner*—Charles L. Bowers, Jr.
*Assistant Examiner*—J. Pasterczyk
*Attorney, Agent, or Firm*—Sughrue, Mion, Zinn, Macpeak & Seas

[57] ABSTRACT

A color development process for processing an imagewise exposed silver halide color photographic material comprising a support having thereon at least one light-sensitive silver halide emulsion layer comprising a color coupler and a silver iodobromide emulsion containing silver iodide in an amount of from 2 to 20 mol %, comprising the step of processing the color photographic material in a color developing solution containing a color developing agent and bromide ion for 40 seconds to 90 seconds, wherein the color developing agent is represented by formula (D'):

(D')

wherein $R_{1d}$, and $R_{2d}$, each represents an alkyl group having 1 to 4 carbon atoms; and $L_1$ represents a straight-chain or branched alkylene group having 3 or 4 carbon atoms, the concentration $\{Br^-\}$ of bromide ion in the color developing solution is from 30 to 60 mmol/l, the relationship between the concentration $\{R\}$ of the color developing agent in the color developing solution and the concentration $\{Br^-\}$ of bromide ion in the color developing solution and the relationship between the development processing temperature Tem and the concentration $\{Br^-\}$ of bromide ion are maintained to satisfy a Rule defined by the following equations: $\{R\}=((0.63\times\{Br^-\})+(14))\pm16$ (mmol/l); $Tem=((0.19\times\{Br^-\})+(39))\pm5$ (°C.), where $\{R\}$ is the concentration of color developing agent in units of mmol/l; $\{Br^-\}$ is the concentration of bromide ion in units of mmol/l; and Tem is the development processing temperature in °C.

7 Claims, No Drawings

COLOR DEVELOPMENT PROCESSING METHOD OF SILVER HALIDE COLOR PHOTOGRAPHIC MATERIAL USING A COLOR DEVELOPER WHERE THE COLOR DEVELOPING AGENT CONCENTRATION AND PROCESSING TEMPERATURE ARE A FUNCTION OF BROMIDE ION CONCENTRATION

FIELD OF THE INVENTION

This invention relates to a color development processing method of a silver halide color photographic material, and more particularly to a rapid color development processing method which scarcely causes fogging and a lowering in sensitivity and further particularly to a method for processing a silver halide color photographic material for photographing which enables rapid color development to be conducted, scarcely causes a lowering in sensitivity and is excellent in graininess.

BACKGROUND OF THE INVENTION

More rapid processing of silver halide color photographic materials (hereinafter referred to sometimes as light-sensitive material) has been demanded in recent years. In the processing of recent types of color paper, color development has been generally carried out by rapid processing of about 45 seconds since high silver chloride emulsions were used. In the processing of color negative for photographing, however, a processing time of about 3¼ minutes (hereinafter referred to as standard processing) has been used as general color development time until today, since processing agent C-41 for color negative was developed by Eastman Kodak in 1972. This is because the high silver chloride emulsions used in color paper can be rapidly developed in comparison with silver halide emulsions containing silver iodide used in color negative films for photographing from the viewpoint of rapidly conducting color development, but sufficiently high sensitivity can not be obtained and hence the high silver chloride emulsions can not be used in the color negative films for photographing.

For this reason, it has been conventionally proposed that the rate of development can be expedited by increasing the development activity of color developing solutions to shorten the development time of the color negative films containing silver halide emulsions containing silver iodide. Methods for increasing the development activity of the color developing solutions include a method using color developing solution having a higher pH; a method wherein the processing temperature is elevated; a method wherein the concentrations of developing agents are increased; and a method wherein development accelerators are used. Examples of the development accelerators conventionally known include thioether compounds described in JP-B-37-16088 (the term "JP-B" as used herein means an "examined Japanese patent publication"), JP-B-37-5987 (corresponding to British Patent 950089) and U.S. Pat. No. 3,813,247, p-phenylenediamine compounds described in JP-A-52-49829 (the term "JP-A" as used herein means an "unexamined published Japanese patent application") and JP-A-50-15554, quaternary ammonium salts described in JP-A-50-137726, and amine compounds described in U.S. Pat. No. 2,494,903. However, it was found that when these methods for increasing the development activity of the color developing solutions are used, problems are caused, namely, fogging is caused, only low sensitivity is obtained in comparison with standard processing, etc., though the rate of development is increased.

Further, JP-A-63-38937, JP-A-63-40144 and JP-A-63-136044 disclose that rapid color development is carried out by controlling the swelling rate or thickness of the light-sensitive materials or increasing the concentrations of developing agents in the color developing solutions. However, it was found that there are problems because an increase of density in unexposed areas (that is, a lowering in S/N ratio) is liable to be caused and sufficient sensitivity can not be obtained, though the rate of development can be increased.

SUMMARY OF THE INVENTION

A first object of the present invention is to provide a processing method which enables the color development of light-sensitive materials using silver halide emulsions containing silver iodide to be carried out by rapid processing of not longer than 2 minutes.

A second object of the present invention is to provide a processing method which is excellent in the ratio (S/N ratio) of the density of low exposed area to the density of unexposed area.

A third object of the present invention is to provide a processing method which can impart sufficient sensitivity even when color development processing is rapidly carried out.

The above-described objects of the present invention have been achieved by the following method.

Namely, the present invention provides a color development processing method for a silver halide color photographic material which comprises processing a silver halide color photographic material having at least one silver halide emulsion layer containing silver iodide with a color developing solution in a period of 30 seconds to 2 minutes, comprising providing a concentration of bromide ion [Br−] contained in the color developing solution of from 30 to 80 mmol/l, and maintaining the relationship between the concentration {R} in units of mmol/l of the color developing agent and that of bromide ion {Br−} in units of mmol/l and the relationship between the processing temperature Tem and the concentration of bromide ion [Br−] to satisfy a Rule defined by the following formulas:

Rule:

$$\{R\}=((0.63\times\{Br^{-1}\})+(14)\pm 16\ (\text{mmol/l})$$

where: R=the concentration of color developing agent, $$Tem=((0.19\times\{Br^{-1}\})+(39))\pm 5\ (^{\circ}\text{C.})$$

where: Tem=processing temperature.

DETAILED DESCRIPTION OF THE INVENTION

The present invention will be illustrated in more detail below.

Generally, it can be expected that color development can be expedited by increasing the concentrations of the developing agents in the color developing solutions or elevating the processing temperature. It is important that not only development is rapid, but also fogging is scarcely caused and sufficient sensitivity can be obtained in a practical photographic processing system.

The present inventors have made studies and found that when the concentrations of the color developing agents are increased, the rate at which fogging rises is greatly increased, though the rate of development is increased, and when the concentration is 83 mmol/l or higher, sensitivity, that is, "exposure amount giving a density of (Fog+a specific density)" can not reach the sensitivity obtained by standard processing. This result is thought to be mainly due to the fact that in relation to the speed of fog area and that of the image area, the relative speed of fog area is increased by rapid processing in comparison with that in standard processing. Further, it has been found that when the processing temperature rises, the above maximum sensitivity can be relatively easily obtained, but fog density itself is high, that is, "sensitivity/fog ratio=S/N ratio" is apt to become worse. Furthermore, it has been found that this relationship is affected by the concentration of bromide ion in the color developing solutions.

According to the Rule of the present invention, conditions must be optimized so that the concentration of the color developing agent is from 16.9 to about 82.9 mmol/liter, and the processing temperature is from about 39.7° to about 59.9° C. It is also necessary that the concentration of the color developing agent is controlled to a value within the concentration of bromide ion ±16 mmol/liter and the processing temperature is controlled to a value within ±5° C. at a given concentration of bromide ion. Namely, it has been found that when a large amount of bromide ion which is a restrainer and conventionally used at a concentration of about 12 mmol/l is used, the concentration of the developing agent and the processing temperature can be optimized and good photographic performance can be obtained by rapid color development of not longer than 2 minutes.

A lower limit of the concentration of bromide ion in the color developing solutions of the present invention is 43 mmol/l, more preferably 45 mmol/l, whereas an upper limit thereof is 67 mmol/l, more preferably 60 mmol/l.

Conventional aromatic primary amine color developing agents can be used as the color developing agents which are present in the color developing solutions of the present invention.

Development is an electrochemical reaction wherein a latent image functions as an electrode, that is, wherein fine silver grains (called a latent image) formed on silver halide by exposure function as a medium, an electron migrates from the developing agent to silver halide and a silver ion in the silver halide receives the electron and is changed to a silver atom which is integrated on the above latent image to thereby allow silver grains to be grown. Accordingly, the developing agent is oxidized and a silver ion is reduced during the course of the development. Namely, when the oxidation-reduction potential of the developing agent is sufficiently low in comparison with the oxidation-reduction potential of silver halide, the reaction proceeds rapidly. Namely, it can be expected that development is rapid. However, since the developing agents having a low oxidation-reduction potential have high activity, silver halide in unexposed areas is easily reduced, that is, fogging is apt to be caused, and substantial sensitivity is liable to be lowered with a rise in fogging. When development is conducted, it is desirable that development in the image area is fast, but development in the fog area is slow.

Preferable color developing agents used in the present invention have a low oxidation-reduction potential in comparison with the developing agent conventionally used in color negative films, to thereby increase the rate of development in the image area and at the same time to inhibit the occurrence of fogging, thus obtaining rapidly good photographic characteristics.

The color developing agents preferably used in the present invention are color developing agents having a half wave potential of not higher than +240 mV as measured with standard hydrogen electrode as reference electrode. The half wave potential of the developing agent is a value described in *Photographic Science and Engineering,* Vol. 8, No. 3, page 125 (1964). In this specification, the value described in the above literature is described by reversing the plus and minus signs according to the European Rule generally used in the field of electrochemistry at present, that is, a rule wherein the plus value of the potential is smaller or the minus value of the potential is larger, the stronger is the reducing agent.

Further, even when color developing agents are compounds whose chemical structure is not described in the above literature, the half wave potential can be measured at a measuring pH of 10 according to the measuring method described in *Journal of the American Chemical Society,* Vol. 30, page 3100 (1951). When the half wave potential obtained by measurement is not higher than +240 mV, the compounds are included within the scope of the color developing agents of the present invention.

The color developing agents which can be preferably used in the present invention are color developing agents having a half wave potential of not higher than +240 mV, represented by the following general formula (D).

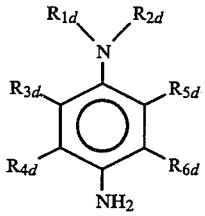

(D)

In general formula (D), $R_{1d}$ and $R_{2d}$ each represents a hydrogen atom, an alkyl group having 1 to 20, preferably 1 to 16 carbon atoms, an aryl group having 6 to 20 preferably 6 to 16 carbon atoms or a heterocyclic group having 1 to 20, preferably 1 to 16 carbon atoms; and $R_{3d}$, $R_{4d}$, $R_{5d}$ and $R_{6d}$ each represents a hydrogen atom or a substituent group; or $R_{1d}$ and $R_{2d}$, $R_{1d}$ and $R_{3d}$, $R_{3d}$ and $R_{4d}$, $R_{2d}$ and $R_{5d}$ or $R_{5d}$ and $R_{6d}$ may be combined together to form a ring.

The compounds of general formula (D) will be illustrated in more detail below.

The alkyl group, the aryl group and the heterocyclic group having 1 to 20, preferably 1 to 16 carbon atoms represented by $R_{1d}$ and $R_{2d}$ may be substituted by one or more of an alkenyl group, an alkynyl group, a hydroxyl group, a nitro group, a cyano group and a halogen atom or substituent groups capable of bonding through an oxygen atom, nitrogen atom, sulfur atom or carbonyl group. Examples of these substituent groups include groups and atoms described as substituent groups for $R_{3d}$, $R_{4d}$, $R_{5d}$ and $R_{6d}$ hereinafter. Preferred substituent groups are a hydroxyl group, a sulfonamido group, a carbamoyl group, a sulfamoyl group and a ureido group with a hydroxyl group and a sulfonamido group being more preferred.

More specifically, $R_{1d}$ and $R_{2d}$ are each a hydrogen atom, an alkyl group (a straight-chain, branched or cyclic alkyl group having 1 to 16 carbon atoms, such as methyl, ethyl, propyl, isopropyl, t-butyl, 2-hydroxyethyl, 3-hydroxypropyl, 2-methanesulfonamidoethyl, 3-methanesulfonamidopropyl, 2-methanesulfonylethyl, 2-methoxyethyl, cyclopentyl, 2-acetamidoethyl, 2-carboxyethyl, 2-carbamoylethyl, 3-carbamoylpropyl, n-hexyl, 2-hydroxypropyl, 4-hydroxybutyl, benzyl, 2-carbamoylaminoethyl, 3-carbamoylaminopropyl, 4-carbamoylaminobutyl, 4-carbamoylbutyl, 2-carbamoyl-1-methylethyl, 4-nitrobutyl, 3-sulfamoylaminopropyl, 4-sulfamoyl), an aryl group (e.g., phenyl, naphthyl, p-methoxyphenyl) or a heterocyclic group (e.g., 2-furyl, 2-thienyl, 2-pyrimidinyl, 2-benztriazolyl, imidazolyl, pyrazolyl, pyrrolidinyl, morphornyl).

The case where at least one of $R_{1d}$ and $R_{2d}$ is an alkyl group having 1 to 10 carbon atoms is preferred, and the case where both $R_{1d}$ and $R_{2d}$ are an alkyl group is more preferred.

When $R_{1d}$ and $R_{2d}$ are an alkyl group, each alkyl group has preferably not more than 8 carbon atoms, more preferably not more than 5 carbon atoms.

Preferably, $R_{3d}$, $R_{4d}$, $R_{5d}$ and $R_{6d}$ are each a hydrogen atom, a halogen atom, an alkyl group, an alkenyl group, an alkynyl group, an aryl group, a heterocyclic group, a cyano group, a nitro group, a hydroxyl group, a carboxyl group, an alkoxy group, an aryloxy group, an acylamino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyl group, a silyloxy group, an aryloxycarbonylamino group, an imido group, a heterocyclic thio group, a sulfinyl group, a phosphoryloxy group, an aryloxycarbonyl group or an acyl group, in which these groups have not more than 20, preferably these groups have 1 to 10 carbon atoms.

More specifically, $R_{3d}$, $R_{4d}$, $R_{5d}$ and $R_{6d}$ are each a hydrogen atom, a halogen atom (e.g., fluorine atom, chlorine atom), an alkyl group (a straight-chain, branched or cyclic alkyl group having 1 to 16 carbon atoms which may be substituted by one or more of an alkenyl group, an alkynyl group, a hydroxyl group, a nitro group, a cyano group, a halogen atom and a substituent group capable of bonding through an oxygen atom, a nitrogen atom, a sulfur atom or a carbonyl group, such as methyl, ethyl, propyl, isopropyl, t-butyl 2-hydroxyethyl , 3-hydroxypropyl , 2-methanesulfonamidoethyl, 3-methanesulfonamidopropyl, 3-methanesulfonylethyl, 2-methoxyethyl, cyclopentyl, 2-acetamidoethyl, 2-carboxyethyl, 2-carbamoylethyl, 3-carbamoylpropyl, n-hexyl, 2-hydroxypropyl, 4-hydroxybutyl, 2-carbamoylaminoethyl, 3-carbamoylaminopropyl, 4-carbamoylaminobutyl, 4-carbamoylbutyl, 2-carbamoyl-1-methylethyl, 4-nitrobutyl), an alkenyl group (e.g., vinyl, 1-butenyl, 3-hydroxy-1-propenyl), an alkynyl group (e.g., ethynyl, 1-propynyl), an aryl group (e.g., phenyl, naphthyl, p-methoxyphenyl), a heterocyclic group (e.g., 2-furyl, 2-thienyl, 2-pyrimidinyl, 2-benztriazolyl, imidazolyl, pyrazolyl), a cyano group, a nitro group, a hydroxyl group, a carboxyl group, an alkoxy group (e.g., methoxy, ethoxy, 2-methoxyethoxy, 2-methanesulfonylethoxy), an aryloxy group (e.g., phenoxy), an acylamino group (e.g. , acetamido, 2-methoxypropionamido), an alkylamino group (e.g., N,N-dimethylamino, N,N-diethylamino), an anilino group (e.g., anilino, m-nitroanilino), a ureido group (e.g., methylureido, N,N-diethylureido), a sulfamoylamino group (e.g., dimethylsulfamoylamino), an alkylthio group (e.g., methylthio, ethylthio), an arylthio group (e.g., phenylthio), an alkoxycarbonylamino group (e.g., methoxycarbonylamino, ethoxycarbonylamino), a sulfonamido group (e.g., methanesulfonamido), a carbamoyl group (e.g., N,N-dimethylcarbamoyt, N-ethylcarbamoyl), a sulfamoyl group (e.g., dimethylsulfamoyl), a sulfonyl group (e.g., methanesulfonyl, ethanesulfonyl), an alkoxycarbonyl group (e.g., methoxycarbonyl, ethoxycarbonyl), a heterocyclic oxy group (e.g., 1-phenyltetrazolyl-5-oxy, 2-tetrahydropyranyloxy), an azo group (e.g., phenylazo, 2-hydroxy-4-propanoylphenylazo), an acyloxy group (e.g., acetoxy), a carbamoyloxy group (e.g., N,N-dimethylcarbamoyloxy), a silyl group (e.g., trimethylsilyl), a silyloxy group (e.g., trimethylsilyloxy), an aryloxycarbonylamino group (e.g., phenoxycarbonylamino), an imido group (e.g., N-succinimido), a heterocyclic thio group (e.g., 2-benzthiazolylthio, 2-pyridylthio), a sulfinyl group (e.g., ethylenesulfinyl), a phosphoryloxy group (e.g., dimethoxyphosphoryloxy), an aryloxycarbonyl group (e.g., phenoxycarbonyl) or an acyl group (e.g., acetyl, benzoyl).

Preferably, $R_{1d}$ and $R_{2d}$ are each a hydrogen atom. More preferably, $R_{3d}$, $R_{4d}$ and $R_{5d}$ are each a hydrogen atom. Preferably, $R_{6d}$ is a hydrogen atom, an alkyl group or an alkoxy group having 1 to 10 carbon atoms. More preferably, $R_{6d}$ is an alkyl group, with a methyl group and an ethyl group being particularly preferred.

$R_{1d}$ and $R_{2d}$, $R_{1d}$ and $R_{3d}$, $R_{3d}$ and $R_{4d}$, $R_{2d}$ and $R_{5d}$, or $R_{5d}$ and $R_{6d}$ may be combined together to form a ring. The number of rings to be formed may be monocyclic, bicyclic or polycyclic. There is no particular limitation with regard to the number of members which form the ring. Preferably, the ring is a five-membered ring, a six-membered ring or a seven-membered ring.

Examples of the ring formed by $R_{1d}$ and $R_{2d}$ include the following rings.

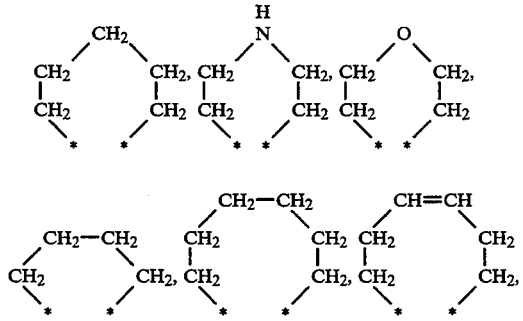

wherein the mark * represent the position where the chain is bonded to $R_{1d}$ or $R_{2d}$. One or more substituent groups may be optionally attached to one or more atoms of the main chain. When the ring is substituted, examples of the substituent groups include those already described above in the definitiion of the substituent groups for $R_{3d}$, $R_{4d}$, $R_{5d}$ and $R_{6d}$.

Examples of the ring formed by $R_{1d}$ and $R_{3d}$ or $R_{2d}$ and $R_{5d}$ include the following rings.

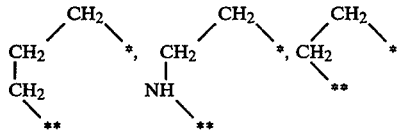

wherein the mark * represents the position where the chain is bonded to $R_{1d}$ or $R_{2d}$, and the mark ** represents the position where the chain is bonded to $R_{3d}$ or $R_{5d}$ in general formula (D). One or more substituent groups may be optionally attached to one or more atoms of the main chain. When the ring is substituted, examples of the substituent group include those already described above in the definition of the substituent groups for $R_{3d}$, $R_{4d}$, $R_{5d}$ and $R_{6d}$.

Examples of the ring formed by $R_{3d}$ and $R_{4d}$, or $R_{5d}$ and $R_{6d}$ include the following rings.

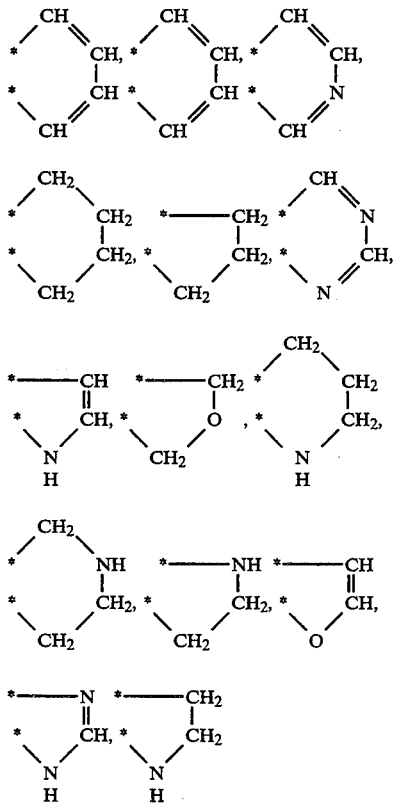

wherein the mark * represents the position where the chain is bonded to the benzene ring of formula (D). Each of the bonding positions may be $R_{3d}$ or $R_{5d}$, or $R_{4d}$ or $R_{6d}$. One or more substituent groups may be optionally attached to one or more atoms of the main chain. When the ring is substituted, examples of the substituent groups include those already described above in the definition of the substituent groups for $R_{3d}$, $R_{4d}$, $R_{5d}$ and $R_{6d}$.

Preferred color developing agents are p-pheylenediamine compounds. Among them, compounds represented by the following general formula (D') are particularly preferred.

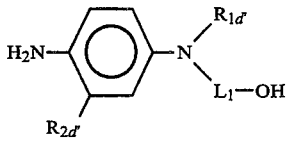

(D')

wherein $R_{1d'}$ and $R_{2d'}$ each represents an alkyl group having 1 to 4 carbon atoms; and $L_1$ represents a straight-chain or branched alkylene group having 3 or 4 carbon atoms.

Examples of $R_{1d'}$ and $R_{2d'}$ of formula (D') include a methyl group, a propyl group, a butyl group and a sec-butyl group. Examples of $L_1$ include a propylene group, a butylene group, a 1-methylethylene group, a 2-ethylmethylene group, a 1-methylpropylene group, a 2-methylpropylene group and a 3-methylpropylene group.

In general formula (D'), $R_{1d'}$ is preferably an ethyl group or a propyl group, $R_{2d'}$ is preferably a methyl group or an ethyl group, and $L_1$ is preferably a propylene group or butylene group, with a butylene group being particularly preferred.

The color developing agents of the present invention have a half wave potential of preferably not higher than +235 mV, more preferably not more than +230 mV, still more preferably more than +225 mV. A lower limit of the half wave potential is +140 mV, preferably +150 mV.

Examples of the color developing agents which can be used in the present invention include, but are not limited to, the following compounds.

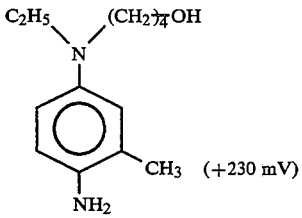

D-1 (+230 mV)

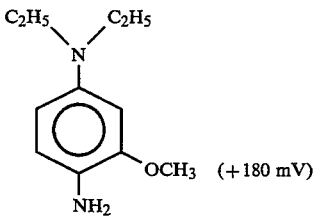

D-2 (+180 mV)

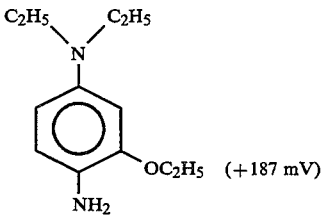

D-3 (+187 mV)

-continued
D-4
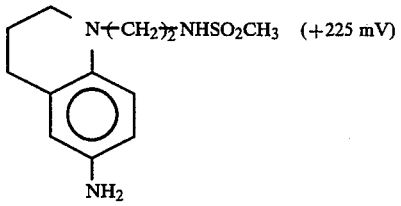
(+225 mV)
D-5
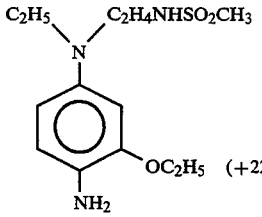
(+226 mV)
D-6
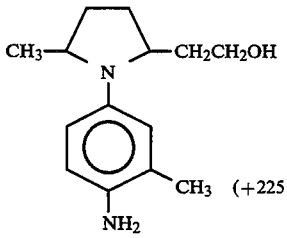
(+225 mV)
D-7
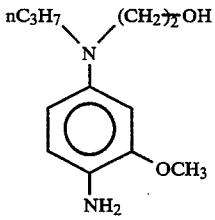
D-8
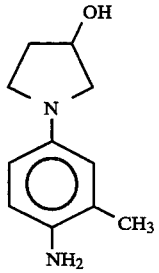
D-9
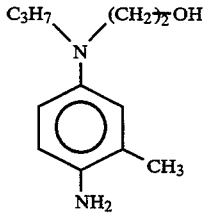
D-10
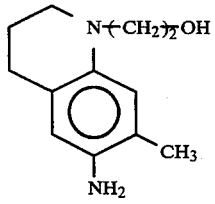
-continued
D-11
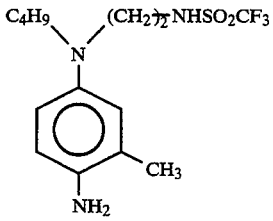
D-12
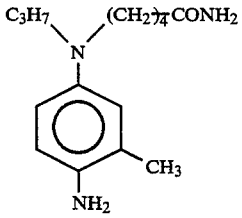
D-13
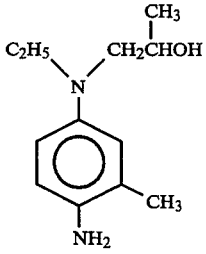
D-14
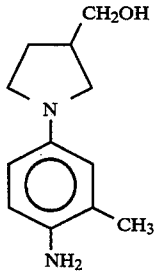
D-15
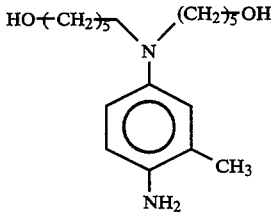
D-16
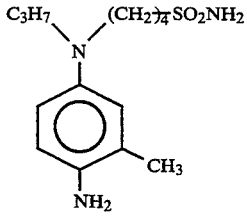
D-17
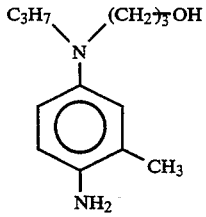

-continued
D-18
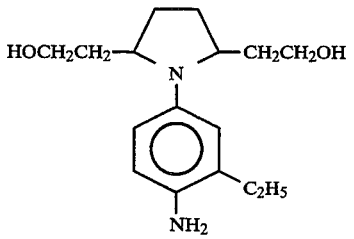
D-19
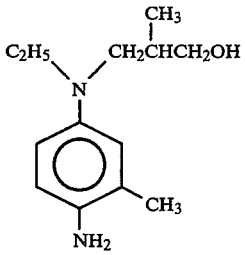
D-20
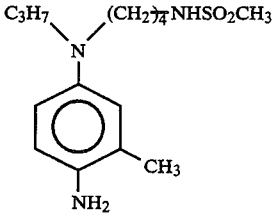
D-21
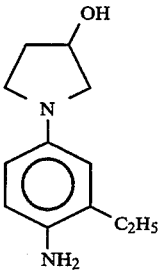
D-22
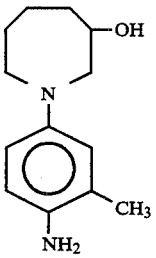
D-23
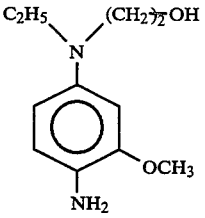
-continued
D-24
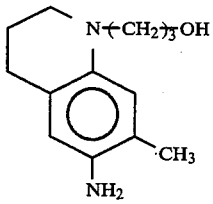
D-25
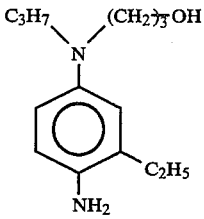
D-26
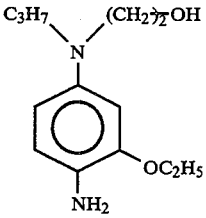
D-27
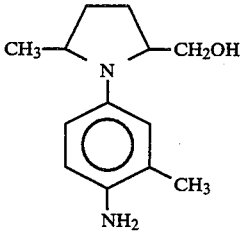
D-28
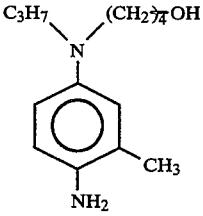
D-29
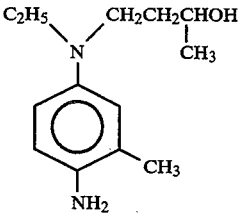
D-30
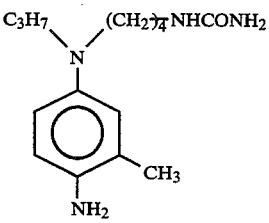

-continued

D-31

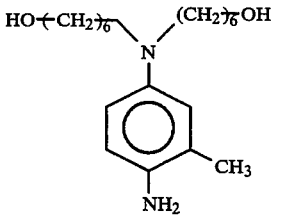

D-32

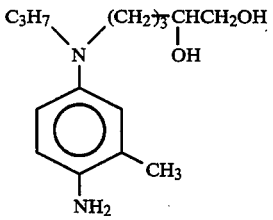

D-33

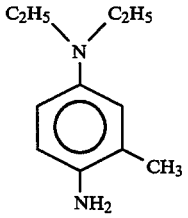

D-34

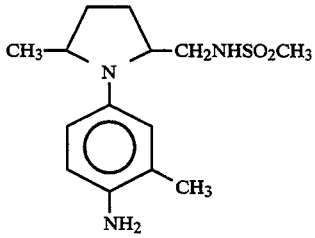

D-35

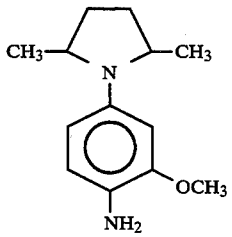

When the color developing agents of the present invention are stored in the form of a free amine, they are very unstable. Accordingly, it is preferred that they are prepared in the form of an inorganic or organic acid addition salt, stored and converted into a free amine when added to the processing solutions. Examples of inorganic or organic acids which can be used in the preparation of the acid addition salts of the color developing agents of the present invention include hydrochloric acid, sulfuric acid, p-toluenesulfonic acid, methanesulfonic acid and naphthalene-1,5-di-sulfonic acid.

The color developing agents of the present invention can be synthesized according to the method described in, for example, *Journal of American Chemical Society,* Vol. 73, page 3100.

Color developing solutions containing the color developing agents of the present invention are preferably an aqueous alkaline solution. The color developing agents of the present invention may be used either alone or as a mixture of two or more of them. The color developing agents of the present invention may be used together with conventional aromatic primary amine color developing agents and conventional black and white developing agents such as dihydroxybenzenes (e.g., hydroquinone), 3-pyrazolidones (e.g., 1-phenyl-3-pyrazolidone) and aminophenols (e.g., N-methyl-p-amino-phenol). The color developing agents of the present invention are used in an amount of $2\times10^{-4}$ to $1\times10^{-1}$ mol, preferably $1\times10^{-3}$ to $5\times10^{-2}$ mol per liter of the processing solution.

A more remarkable effect can be obtained by the present invention when the color developing solutions contain at least 0.1 g/l of at least one compound represented by the following general formula (A).

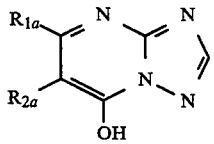

(A)

wherein $R_{1a}$ represents a methyl group, an ethyl group or a propyl group; and $R_{2a}$ represents a hydrogen atom; or $R_{1a}$ and $R_{2a}$ together may form a five-membered or six-membered ring through an alkylene group.

Examples of the compounds of general formula (A) include the following compounds.

A-1

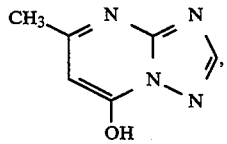

A-2

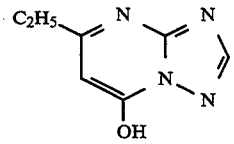

A-3

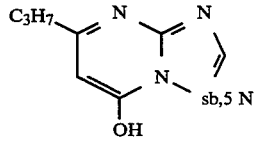

A-4

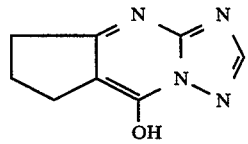

A-5

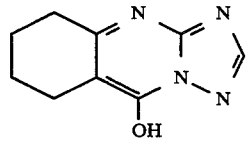

The compounds of general formula (A) are presented in the color developing solution in an amount of preferably at least 0.15 g/l, more preferably at least 0.2 g/l. The upper limit is preferably 0.8 g/l, more preferably 0.5 g/l.

It is desirable that the color developing solutions of the present invention contain at least one compound represented by the following general formula (E).

$$L_{1e}—(A_{1e}—L_{2e})_r—A_{2e}—L_{3e} \quad (E)$$

wherein $L_{1e}$ and $L_{3e}$ may be the same or different and each represents an alkyl group or a heterocyclic group having 1 to 20, preferably 1 to 10 carbon atoms, provided that at least one of $L_{1e}$ and $L_{3e}$ is an alkyl or heterocyclic group substituted by $—OM_{1e}$, $—SO_3M_{1e}$, $—PO_3M_{2e}M_{3e}$, $—NR_{1e}(R_{2e})$, $—N^+R_{3e}(R_{4e})(R_{5e})\cdot X_{e1}$, $—SO_2NR_{6e}(R_{7e})$, $—NR_{8e}SO_2R_{9e}$, $—CONR_{10e}(R_{11e})$, $—SO_2R_{12e}$, $—COOM_{1e}$ or a heterocyclic group.

In formula (E) $L_{2e}$ represents an alkylene group having 1 to 20 carbon atoms, an arylene group having 6 to 20 carbon atoms, an aralkylene group having 6 to 20 carbon atoms, a heterocyclic bonding group or a bonding group having 1 to 20 carbon atoms composed of a combination of two or more of these groups; $A_{1e}$ and $A_{2e}$ may be the same or different groups and each represents —S—, —O—, $—N(R_{12e})—$, —CO— or any combination of two or more groups thereof, provided that at least one of $A_{1e}$ and $A_{2e}$ is —S—; r represents an integer of 1 to 10 and when r is 2 or greater, two or more $(A_{1e}–L_{2e})$ groups may be the same or different.

In formula (E) $M_{1e}$, $M_{2e}$ and $M_{3e}$ may be the same or different and each represents a hydrogen atom or a counter cation; $R_{1e}$ to $R_{12e}$ may be the same or different and each represents a hydrogen atom, an alkyl group having 1 to 20, preferably 1 to 10 carbon atoms, an aryl group, or an aralkyl group having 6 to 20, preferably 6 to 10 carbon atoms or an alkenyl group having 1 to 20, preferably 1 to 10 carbon atoms; and $X_{1e}^-$ represents a counter anion.

The compounds of general formula (E) will be illustrated in more detail below.

$L_{1e}$ and $L_{3e}$ in formula (E) are each a substituted or unsubstituted alkyl group having 1 to 10 carbon atoms (examples of unsubstituted alkyl group include methyl, ethyl, propyl, hexyl, isopropyl) or a substituted or unsubstituted heterocyclic group having 1 to 10 carbon atoms (examples of unsubstituted heterocyclic group include pyridyl, furyl, thienyl, imidazolyl) provided that at least one of $L_{1e}$ and $L_{2e}$ is an alkyl or heterocyclic group substituted by $—OM_{1e}$, $—SO_3M_{1e}$, $—PO_3M_{2e}M_{3e}$, $—NR_{1e}(R_{2e})$ (which may be in the form of hydrochloride or acetate, such as, unsubstituted amino, methylamino, dimethylamino, N-methyl-N-hydroxyethyl-amino, N-ethyl-N-carboxyethylamino), $—N^+R_{3e}(R_{4e})(R_{5e})\cdot X_{1e}^-$ (e.g., trimethylammoniochloride), $—SO_{2e}NR_{6e}(R_{7e})$ (e.g., unsubstituted sulfamoyl, dimethylsulfamoyl ), $—NR_{8e}SO_{2e}R_{9e}$ (e.g., methanesulfonamido, benzenesulfonamido), $—CONR_{10e}(R_{11e})$ (e.g., unsubstituted carbamoyl, N-methylcarbamoyl, N,N-bis(hydroxyethyl)carbamoyl), $—SO_2R_{14e}$ (e.g., methanesulfonyl, 4-chlorophenylsulfonyl), a heterocyclic group (e.g., pyridyl, imidazolyl, thienyl, tetrahydrofuranyl) or $—COOM_{1e}$.

$M_{1e}$, $M_{2e}$ and $M_{3e}$ in formula (E) are each a hydrogen atom or a counter cation (e.g., an alkali metal atom such as sodium atom or potassium atom, an alkaline earth metal such as magnesium atom or calcium atom, or an ammonium group such as ammonium or triethylammonium).

$R_{1e}$ to $R_{12e}$ in formula (E) are each a hydrogen atom, a substituted or unsubstituted alkyl group having 1 to 10 carbon atoms (e.g., methyl, ethyl, propyl, hexyl, isopropyl), a substituted or unsubstituted aryl group having 6 to 12 carbon atoms (e.g., phenyl, 4-methylphenyl, 3-methoxyphenyl), a substituted or unsubstituted aralkyl group having 7 to 12 carbon atoms (e.g., benzyl, phenethyl) or a substituted or unsubstituted alkenyl group having 2 to 10 carbon atoms (e.g., vinyl, propenyl, 1-methylvinyl ); and $X^-$ is a counter anion (e.g., a halide ion such as chloride ion or bromide ion, nitrate ion, sulfate ion, acetate ion, p-toluenesulfonate ion).

$L_{2e}$ in formula (E) is a substituted or unsubstituted alkylene group having 1 to 10 carbon atoms (e.g., methylene, ethylene, trimethylene, tetramethylene, pentamethylene, hexamethylene, 1-tetramethylene, 1-hydroxytrimethylene), a substituted or unsubstituted arylene group having 6 to 12 carbon atoms (e.g., phenylene, naphtylene), a substituted or unsubstituted aralkylene group having 7 to 12 carbon atoms (e.g., 1,2-xylylene), a substituted or unsubstituted heterocyclic bonding group having 1 to 10 carbon atoms (e.g.,

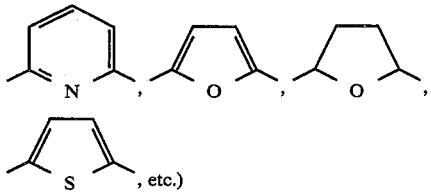

or a bonding group composed of a combination of two or more of these groups (e.g.,

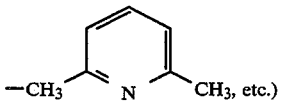

$A_{1e}$ and $A_{2e}$ in formula (E) are each —S—, —O—, $—NR_{12e}—$, —CO— or a any combination of two or more of these groups. Examples of the group comprising a combination with one or more of these groups include $—CONR_{13e}—$, $—NR_{14e}CO—$, $—NR_{15e}CONR_{10e}—$, —COO— and —OCO—. $R_{13e}$ to $R_{16e}$ have the same meaning as $R_{12e}$.

At least one of $A_{1e}$ and $A_{2e}$ in formula (E) is —S—.

r is an integer of 1 to 10, and where r is 2 or greater, two or more $(A_{1e}–L_{2e})$ groups may be the same or different.

When each of $L_{1e}$, $L_{2e}$, $L_{3e}$ and $R_{1e}$ to $R_{16e}$ is substituted, examples of substituent groups include a lower alkyl group having 1 to 4 carbon atoms (e.g., methyl, ethyl), an aryl group having 6 to 10 carbon atoms (e.g., phenyl, 4-methylphenyl), an aralkyl group having 7 to 10 carbon atoms (e.g., benzyl), an alkenyl group having 2 to 4 carbon atoms (e.g., propenyl), an alkoxy group having 1 to 4 carbon atoms (e.g., methoxy, ethoxy), a halogen atom (e.g., chlorine atom, bromine atom), a cyano group, a nitro group, a carboxyl group (which may be in the form of a salt) and a hydroxyl group.

Preferably, at least one of $L_{1e}$ and $L_{3e}$ in general formula (E) is an alkyl group substituted by $—OM_{1e}$, $—SO_3M_{1e}$, $—PO_3M_{2e}M_{3e}$, $—NR_{1e}(R_{2e})$, $—N^+R_{3e}(R_{4e})—(R_{5e})\cdot X_{1e}^-$, a heterocyclic group or $—COOM_{1e}$; $L_{2e}$ is an alkylene group having 1 to 6 carbon atoms; $A_{1e}$ and $A_{2e}$ are each —S—, —O— or $—NR_{12e}—$ provided that at least one of $A_{1e}$ and $A_{2e}$ is —S—; $R_{1e}$, $R_{2e}$, $R_{3e}$, $R_{4e}$, $R_{5e}$ and $R_{12e}$ are each a hydrogen atom or an alkyl group having 1 to 6 carbon atoms; and r is an integer of 1 to 6 and when r is 2 or greater, two or more ($A_{1e}$–$L_{2e}$) groups may be the same or different.

More preferably, $L_{1e}$ and $L_{3e}$ in general formula (E) are each an alkyl group having 1 to 4 carbon atoms substituted by —$OM_{1e}$, —$SO_3M_{1e}$, —$PO_3M_{2e}M_{3e}$ or —$COOM_{1e}$; $A_{1e}$ and $A_{2e}$ are each —S—; and r is an integer of 1 to 3.

Examples of the compounds of formula (E) which can be used in the present invention include, but are not limited to, the following compounds.

$HO(CH_2)_2S(CH_2)_2S(CH_2)_2OH$ (1)

$HOOC(CH_2)_2S(CH_2)_2S(CH_2)_2COOH$ (2)

$HO(CH_2)_2S(CH_2)_2S(CH_2)_2COOH$ (3)

$NaO_3S(CH_2)_2S(CH_2)_2S(CH_2)_2SO_3Na$ (4)

$HO(CH_2)_2(SCH_2CH_2)_2S(CH_2)_2OH$ (5)

$HOOC(CH_2)_2(SCH_2CH_2)_2S(CH_2)_2COOH$ (6)

$NaO_3S(CH_2)_2(SCH_2CH_2)_2S(CH_2)_2SO_3Na$ (7)

$HO(CH_2)_2(SCH_2CH_2)_3S(CH_2)_2OH$ (8)

$HOOC(CH_2)_2(SCH_2CH_2)_3S(CH_2)_2COOH$ (9)

$NaO_3S(CH_2)_2(SCH_2CH_2)_3S(CH_2)_2SO_3Na$ (10)

$HO(CH_2)_3S(CH_2)_2S(CH_2)_3OH$ (11)

$HOOC(CH_2)_3S(CH_2)_2S(CH_2)_3COOH$ (12)

$HO(CH_2)_3S(CH_2)_2S(CH_2)_3SO_3Na$ (13)

$NaO_3S(CH_2)_3S(CH_2)_2S(CH_2)_3SO_3Na$ (14)

$NaO_3S(CH_2)_3(SCH_2CH_2)_2S(CH_2)_3SO_3Na$ (15)

$NaO_3S(CH_2)_3(SCH_2CH_2)_3S(CH_2)_3SO_3Na$ (16)

$HO(CH_2)_3S(CH_2)_2O(CH_2)_2S(CH_2)_3OH$ (17)

$HOOC(CH_2)_3S(CH_2)_2O(CH_2)_2S(CH_2)_3COOH$ (18)

$HO(CH_2)_2S(CH_2)_2N(CH_3)(CH_2)_2S(CH_2)_2OH$ (19)

$HO(CH_2)_2S(CH_2)_2N((CH_2)_2OH)(CH_2)_2S(CH_2)_2OH$ (20)

$HOOC(CH_2)_2S(CH_2)_2N((CH_2)_2COOH)(CH_2)_2S(CH_2)_2COOH$ (21)

$NaOOC(CH_2)_3S(CH_2)_2CONH(CH_2)_2NHCO(CH_2)_2S(CH_2)_3COOH$ (22)

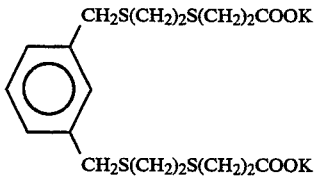

(23)

-continued

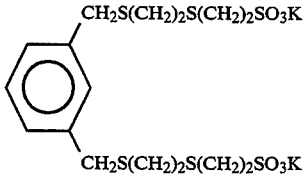

(24)

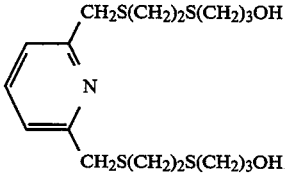

(25)

$Na_2O_3P(CH_2)_2S(CH_2)_2S(CH_2)_2PO_3Na_2$ (26)

$Na_2O_3P(CH_2)_2(SCH_2CH_2)_2S(CH_2)_2PO_3Na_2$ (27)

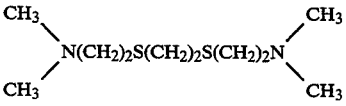

(28)

$(CH_3)_3\overset{\oplus}{N}(CH_2)_2S(CH_2)_2S(CH_2)_2\overset{\oplus}{N}(CH_2)_3\ 2Cl^{\ominus}$ (29)

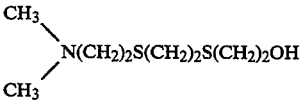

(30)

$(CH_3)_3\overset{\oplus}{N}(CH_2)_2S(CH_2)_2S(CH_2)_2SO_3Na$ (31)

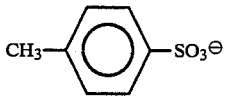

$H_2N(CH_2)_2S(CH_2)_2S(CH_2)_2OH$ (32)

$H_2N(CH_2)_2S(CH_2)_2S(CH_2)_2NH_2$ (33)

$H_2NO_2S(CH_2)_2S(CH_2)_2S(CH_2)_2SO_2NH_2$ (34)

$CH_3SO_2(CH_2)_3S(CH_2)_3S(CH_2)_2OH$ (35)

$CH_3SO_2(CH_2)_3S(CH_2)_3S(CH_2)_2SO_3Na$ (36)

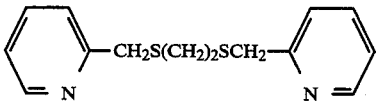

(37)

$CH_3SO_2N(CH_3)(CH_2)_2NH(CH_2)_2S(CH_2)_2CONH_2$ (38)

The compounds of general formula (E) according to the present invention can be easily synthesized by referring to the methods described in *Journal of Organic Chemistry* 30, 2867 (1965), ibid. 27, 2848 (1962) and *Journal of American Chemical Society* 69, 2330 (1947).

The compounds of general formula (E) are used in an amount of $1\times10^{-6}$ to $1\times10^{-1}$ mol, preferably $1\times10^{-5}$ to $5\times10^{-2}$ mol per liter of the color developing solution.

The color developing solutions of the present invention may contain hydroxylamines described in JP-A-63-5341, JP-A-63-106655 or JP-A-4-144446, hydroxamic acids described in JP-A-63-43138, hydrazines and hydrazides described in JP-A-63-146041, phenols described in JP-A-63-44657 and JP-A-63-58443, α-hydroxyketones and α-aminoketones described in JP-A-63-44656, and saccharide described in JP-A-63-36244 as compounds capable of directly preserving the aromatic primary amine color developing agents. In combination with the above compounds, there can be used monoamines described in JP-A-63-4235, JP-A-63-24254, JP-A-63-21647, JP-A-63-146040, JP-A-63-27841 and JP-A-63-25654, diamines described in JP-A-63-30845, JP-A-63-14640 and JP-A-63-43139, polyamines described in JP-A-63-21647, JP-A-63-26655 and JP-A-63-44655, nitroxy radicals described in JP-A-63-53551, alcohols described in JP-A-63-43140 and JP-A-63-53549, oximes described in JP-A-63-56654 and tertiary amines described in JP-A-63-239447.

Examples of other preservatives which may be optionally contained in the developing solutions include sulfite salts, bisulfite salts, metals described in JP-A-57-44148 and JP-A-57-53749, salicylic acids described in JP-A-59-180588, alkanolamines described in JP-A-54-3582, polyethyleneimines described in JP-A-56-94349, and aromatic polyhydroxy compounds described in U.S. Pat. No. 3,746,544.

Particularly preferred preservatives are hydroxylamines of general formula (I) described in JP-A-3-144446. Among them, compounds having sulfo group or carboxyl group are particularly preferred.

Further, various additives described in JP-A-3-144446 can be used in the color developing solutions of the present invention. Examples of the additives include buffering agents for keeping pH, such as carbonic acids, phosphoric acids, boric acids and hydroxybenzoic acids described in JP-A-3-144446 (the 6th line of right upper column to the first line of left lower column of page 9); chelating agents such as aminopolycarboxylic acids, phosphonic acids and sulfonic acids, preferably ethylenediaminetetraacetic acid, triethylenetetraminehexaacetic acid, 1,3-diaminopropanoltetraacetic acid, diethylenetriaminepentaacetic acid, ethylenediamine-N,N,N',N'-tetrakis(methylenephoshonic acid), catechol-3,5-disulfonic acid described in said patent publication (the second line of left lower column to the 18th line of right lower column of page 9); development accelerators described in said patent publication (the 19th line of left lower column of page 9 to the 7th line of right upper column of page 10); and anti-fogging agents such as halide ions and organic anti-fogging agents described in said patent publication (the 8th line of right upper column to the 5th line of left lower column of page 10). If desired, surfactants such as alkylsulfonic acids, arylsulfonic acids, aliphatic carboxylic acids and aromatic carboxylic acids may be added.

It is preferred from the viewpoint of reducing waste liquor that the replenishment rate of the color developing solution is small. The replenishment rate is preferably not more than 300 ml, more preferably 250 ml, still more preferably 200 ml per $m^2$ of the light-sensitive material. The lower limit is preferably not less than an amount brought into the next bath, and the lower limit is preferably about 50 to 100 ml.

The contact area of the photographic processing solution in the processing bath with air can be represented by an opening ratio defined below.

Opening ratio ($cm^{-1}$) =

[Contact area ($cm^2$) of processing solution with air] ÷

-continued

[Capacity ($cm^3$) of processing solution]

The opening ratio is preferably not more than 0.1 $cm^{-1}$, more preferably 0.001 to 0.05 $cm^{-1}$. Examples of methods for reducing the opening ratio include a method wherein a cover such as a floating cover is provided on the surface of the photographic processing solution in the processing bath; a method using a movable cover as described in JP-A-1-82033; and a slit development processing method described in JP-A-63-216050. It is preferred that the reduction of the opening ratio is applied to not only the color development stage but also all of subsequent stages such as bleaching, blixing, fixing, rinsing and stabilization stages.

The processing time of color development is set to a time of from 30 seconds to 2 minutes. The processing time in the present invention is preferably not shorter than 40 seconds, but not longer than 90 seconds, more preferably not shorter than 45 seconds, but not longer than 60 seconds.

The color developing solutions can be reused after regeneration. The regeneration of the color developing solution refers to a process in which the exhausted developing solution is subjected to a treatment with an anion exchange resin or electrodialysis, or a reagent called a regenerant is added thereto to increase the activity of the color developing agent. The resulting regenerated color developing solution is reused. In this case, the regeneration ratio (the proportion of overflow solution in the replenisher) is preferably at least 50%, particularly preferably at least 70%. In the regeneration of the color developing solution, the overflow solution of the color developing solution is regenerated and then used as a replenisher.

In a preferred embodiment, the regeneration of the color developing solution is made by a method using an anion exchange resin. Examples of the compositions of particularly preferred anion exchange resins and the regeneration methods thereof include those described in *Diaion Manual* (*I*) (the 14th edition 1986) published by Mitsubishi Kasei Corporation. Among the anion exchange resins, resins having compositions described in JP-A-2-952 and JP-A-1-281152 are preferred.

After color development, the light-sensitive materials of the present invention are subjected to a desilverization treatment. The desilverization treatment comprises basically a bleaching treatment and a fixing treatment. These treatments may be carried out simultaneously or separately. Namely, the desilverization treatment may comprise a blixing treatment wherein these treatments are simultaneously carried out, or a combination thereof wherein the bleaching treatment and the fixing treatment are separately carried out.

Examples of bleaching agents which can be preferably used in bleaching solutions and/or in blixing solutions include the iron(III) complexes of aminopolycarboxylic acids or salts thereof described in the aforesaid JP-A-3-144446 (the 13th line of right upper column of page 11 to the 4th line of left upper column of page 12), and the iron(III) complexes of organic acids or salts thereof described in JP-A-1-93740, JP-A-3-216650, JP-A-4-22948, JP-A-4-73645, JP-A-4-73647, JP-A-4-127145, JP-A-4-134450, JP-A-4-174432, JP-A-5-66527, Japanese Patent Application Nos. 2-196972, 3-175708, and EP 520457.

The iron(III) complex salts of organic acids represented by the following general formula (H) can be preferably used as bleaching agents in the present invention.

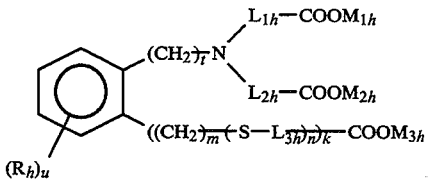

(H)

wherein $L_{1h}$, $L_{2h}$ and $L_{3h}$ each represents an alkylene group having 1 to 20, preferably 1 to 10 carbon atoms; $M_{1h}$, $M_{2h}$ and $M_{3h}$ each represents hydrogen atom or a cation; R represents a substituent group; u represents 0, 1, 2, 3 or 4; and k, t, m and n each represents 0 or 1.

The organic acids of general formula (H) will be illustrated in more detail below.

Examples of the substituent group represented by R include an alkyl group (e.g., methyl group, ethyl group), an aralkyl group (e.g., phenylmethyl group), an alkenyl group (e.g., allyl group), an alkynyl group, an alkoxy group (e.g., methoxy group, ethoxy group), an aryl group (e.g., phenyl group, p-methylphenyl group), an amino group (e.g., dimethylamino group, an acylamino group such as acetylamino group, a sulfonylamino group such as methanesulfonylamino group), a ureido group, a urethane group, an aryloxy group (e.g., phenyloxy group), a sulfamoyl group (e.g., methylsulfamoyl group), a carbamoyl group (e.g., carbamoyl group, methylcarbamoyl group), an alkylthio group (e.g., methylthio group), an arylthio group (e.g., phenylthio group), a sulfonyl group (e.g., methanesulfonyl group), a sulfinyl group (e.g., methanesulfinyl group), a hydroxyl group, a halogen atom (e.g., chlorine atom, bromine atom, fluorine atom), a cyano group, a sulfo group, a carboxyl group, a phosphono group, an aryloxycarbonyl group (e.g., phenyloxycarbonyl group), an acyl group (e.g., acetyl group, benzoyl group), an alkoxycarbonyl group (e.g., methoxycarbonyl group), an acyloxy group (e.g., acetoxy group), a carbonamido group, a sulfonamido group, a nitro group and a hydroxamic acid group. When these substituent groups are those having a carbon chain, the number of carbon atoms is preferably 1 to 4.

When u is 2 or greater, two or more $R_h$ groups may be the same or different, or may be combined together to form a ring.

The alkylene group represented by $L_{1h}$, $L_{2h}$ and $L_{3h}$ in formula (H) may be a straight-chain or branched group and has preferably 1 to 6 carbon atoms. $L_{1h}$, $L_{2h}$ and $L_{3h}$ may be the same or different and may be substituted. Examples of substituent groups include those already described above in the definition of the substituent group for $R_h$. Preferably, $L_{1h}$, $L_{2h}$ and $L_{3h}$ are each a methylene group or an ethylene group.

Examples of the cation represented by $M_{1h}$, $M_{2h}$ and $M_{3h}$ in formula (H) include alkali metals (e.g., lithium, sodium, potassium), ammonium groups (e.g., ammonium, tetraethylammonium) and pyridinium.

Specific examples of the organic acids of general formula (H) which can be used in the preparation of the bleaching agents of the present invention include, but are not limited to, the following compounds.

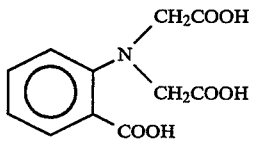

H-1

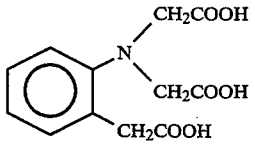

H-2

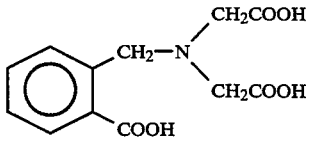

H-3

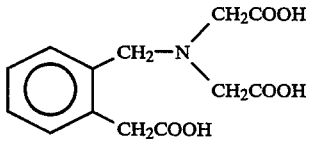

H-4

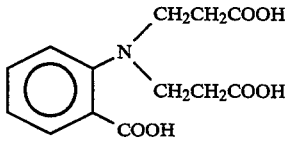

H-5

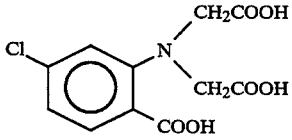

H-6

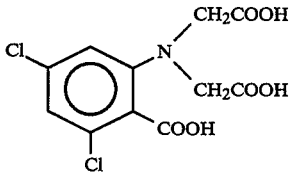

H-7

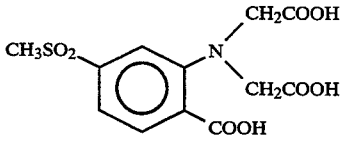

H-8

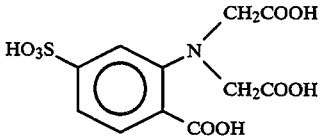

H-9

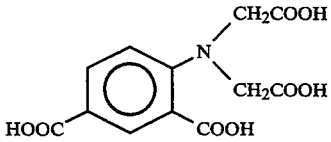

H-10

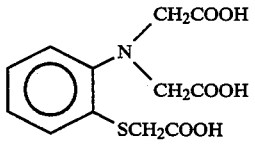

H-11

-continued

H-12

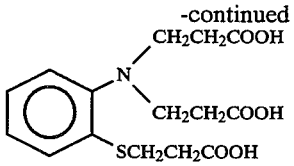

H-13

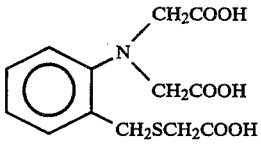

H-14

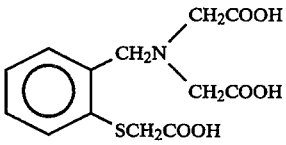

H-15

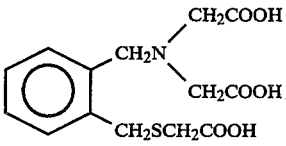

H-16

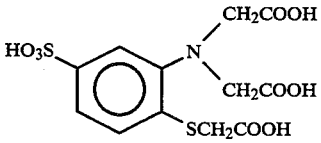

H-17

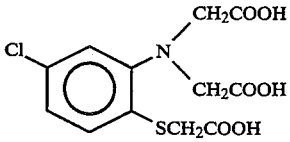

H-18

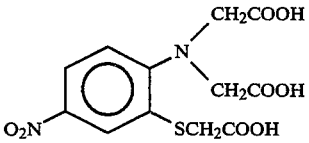

H-19

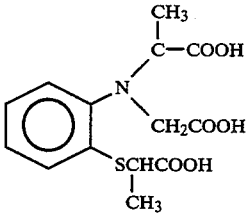

H-20

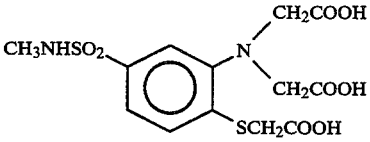

Typical examples of synthesis methods of the organic acids of general formula (H) will be illustrated below.

SYNTHESIS EXAMPLE 1

Synthesis of Compound 1

There were placed 20.0 g (0.146 mol) of anthranilic acid and 20 ml of water in a three-necked flask. While they were thoroughly stirred in an ice bath, 29.2 ml (0.146 mol) of an aqueous solution of 5N sodium hydroxide was added thereto. After anthranilic acid was dissolved, the temperature of the mixture was brought to room temperature, and 52.3 g (0.449 mol) of chloroacetic acid was added thereto. The mixture was stirred with heating at 60° C. in an oil bath, and 85 ml of an aqueous solution of 5N sodium hydroxide was added dropwise thereto. (The dropwise addition of the aqueous solution of 5N sodium hydroxide was made at such a rate that the reaction mixture was kept at a pH of 9 to 11).

After the mixture was stirred with heating, the temperature of the mixture was cooled to room temperature, and 45.6 g (0.450 mol) of concentrated hydrochloric acid was added. The precipitated crystal was recovered by filtration and washed with water. The crystal was put into a beaker, and 300 ml of water was added thereto. The pH of the mixture was adjusted to from 1.6 to 1.7 by using concentrated hydrochloric acid. After the mixture was stirred for one hour, solids were recovered by filtration and thoroughly washed with water and recrystallized from water to obtain 25.7 g (0.0991 mol) of the desired product as $\frac{1}{3}$ hydrate. Yield: 68%. Melting point: 214°–216° C. (decomposition).

| Elemental analysis for $C_{11}H_{11}N_1O_6 \cdot \frac{1}{3}H_2O$ | | | |
|---|---|---|---|
| | H (%) | C (%) | N (%) |
| Calculated: | 4.53 | 50.97 | 5.40 |
| Found: | 4.46 | 51.13 | 5.44 |

SYNTHESIS EXAMPLE 2

Synthesis of Compound 11

There was dissolved 50.0 g (0.399 mol) of o-aminothiophenol in 300 ml of water in a nitrogen gas atmosphere. While the mixture was heated at 80° to 85° C. with stirring, 300 ml of an aqueous solution of 153 g (1.31 mol) of sodium chloroacetate was added dropwise thereto. After the temperature of the mixture was elevated to 90° to 95° C., 100 ml of an aqueous solution of 52.4 g (1.31 mol) of sodium hydroxide was slowly added dropwise thereto. The mixture was reacted at that temperature for 5 hours. The temperature of the reaction mixture was cooled to room temperature, and the pH thereof was adjusted to about 1.7 by using 5N hydrochloric acid. The precipitated solids were recovered by filtration and washed with water to obtain 84.7 g(0.283 mol) of the desired product. Yield: 71%. NMR spectrum and elemental analysis confirmed the structure of the compound.

| | Elemental analysis | | | |
|---|---|---|---|---|
| | H (%) | C (%) | N (%) | S (%) |
| Calculated: | 4.38 | 48.16 | 4.68 | 10.71 |
| Found: | 4.46 | 48.01 | 4.52 | 10.53 |

Other compounds can be prepared in the same manner as described above.

The bleaching agents of the present invention are used in an amount of 3 to 120 mmol, preferably 10 to 100 mmol, more preferably 30 to 100 mmol per liter of the bleaching solution or the bleaching-fixing solution. If desired, inorganic compound bleaching agents may be used together with the iron(III) complex salts of the organic acids according to the present invention. Examples of the inorganic compound bleaching agents include hydrogen peroxide, persulfates and bromates. When these inorganic compound bleaching agents are used, the iron(III) complex salts of the organic acids may be used at a low concentration of 3 to 10 mmol.

The bleaching solutions and/or the blixing solutions of the present invention may contain rehalogenating agents, pH buffering agents and other conventional additives described in JP-A-3-144446 (the 10th line of left upper column of page 12 to the 19th line of left lower column of page 12), amiopolycarboxylic acids and organic phosphonic acids in addition to the bleaching agents.

If desired, the bleaching solutions and/or the blixing solutions or a prebath thereof may contain bleaching accelerators. Examples of the bleaching accelerators include compounds having a mercapto group or disulfide group, such as described in U.S. Pat. No. 3,893,858, German Patents 1,290,821, U.K. Patent 1,138,842, JP-A-53-95630, and *Research Disclosure* No. 17129 (July 1978); thiazolidine compounds described in JP-A-50-140129; thiourea compounds described in U.S. Pat. No. 3,706,561; iodides described in JP-A-58-16235; polyoxyethylene compounds described West German Patents 2,748,430; and polyamine compounds described in JP-B-45-8836 . Particularly, mercapto compounds as described in U.K. Patent 1,138,842 and JP-A-2-190856 are preferred.

The fixing solutions and/or the blixing solutions may contain preservatives such as sulfites (e.g., sodium sulfite, potassium sulfite, ammonium sulfite), hydroxylamines, hydrazines, the bisulfite adducts of aldehyde compounds (e.g., acetaldehyde sodium bisulfite adduct, particularly preferably compounds described in JP-A-3-158848) and sulfinic acid compounds described in JP-A-1-231051, fluorescent brighteners, anti-foaming agents, polyvinyl pyrrolidone and organic solvents such as methanol. Further, the fixing solutions and/or the blixing solutions may contain chelating agents such as aminopolycarboxylic acids and organic phosphonic acids to stabilize the processing solution. Preferred examples of the chelating agents include 1-hydroxyethylidene-1,1-diphosphonic acid, ethylenediamine-N,N,N',N'-tetrakis(methylenephosphonic acid), nitrilotrimethylenephosphonic acid, ethylenediaminetetraacetic acid, diethylenetriaminepentaacetic acid, cyclohexanediaminetetraacetic acid and 1,2-propylenediaminetetraacetic acid. Among them, 1-hydroxyethylidene-1,1-diphosphonic acid and ethylenediaminetetraacetic acid are particularly preferred.

It is preferred that the fixing solutions and/or the blixing solutions contain compounds having a pKa of 6.0 to 9.0 as buffering agents to adjust pH. For this purpose, imidazole compounds are preferred.

The imidazole compounds include imidazole and derivatives thereof. Preferred examples of substituent groups for imidazole include an alkyl group, an alkenyl group, an alkynyl group, an amino group, nitro group and a halogen atom. Further, the alkyl group, the alkenyl group and the alkynyl group may be substituted by one or more of an amino group, nitro group and halogen atoms. The substituent groups for imidazole have preferably 1 to 6 carbon atoms. The most preferred substituent group is methyl group.

Examples of the imidazole compounds include imidazole, 1-methylimidazole, 2-methylimidazole, 4-methylimidazole, 4-(2-hydroxyethyl)imidazole, 2-ethylimidazole, 2-vinylimidazole, 4-propylimidazole, 4-(2-aminoethyl)imidazole, 2,4-dimethylimidazole and 2-chloroimidazole. Among them, preferred compounds are imidazole, 2-methylimidazole and 4-methylimidazole. The most preferred compound is imidazole.

These imidazole compounds are used in an amount of preferably at least 0.01 mol/l, more preferably 0.1 to 10 mol/l, particularly preferably 0.2 to 3 mol/l.

When the processing of the present invention is carried out by using a replenishment system, the replenishment rate of the fixing solution or the blixing solution is preferably 100 to 3000 ml, more preferably 300 to 1800 ml per $m^2$ of the light-sensitive material. The replenishment of the blixing solution may be made by a blixing replenisher, or the overflow solutions of the bleaching solution and the fixing solution may be used as described in JP-A-61-143755 and JP-A-3-213853.

It is preferred that the processing solutions having an ability of bleaching are aerated when processing is conducted in the present invention. Aeration can be carried out by conventional means in the art. For example, aeration may be made by blowing air into the bleaching solutions or allowing air to be absorbed by the solutions through an ejector.

It is preferred that air is introduced into the solutions through a diffuser having fine pores when air is to be blown into the solutions. Such a diffuser is widely used in aeration tanks in activated sludge process. Aeration is described in more detail in Z-121, Using Process C-41, the third edition (1982), pp. BL-1 to BL-2, published by Eastman Kodak.

The bleaching solutions can be reused by recovering overflow solution after processing and adding required ingredients thereto to correct the composition thereof. Such a treatment is generally called regeneration. Such regeneration can be preferably used in the present invention. The details of regeneration are described in Fuji Film Processing Manual Fuji Color Negative Film CN-16 Processing (revised August 1990), pp. 39–40, published by Fuji Photo Film Co., Ltd.

With regard to the regeneration of the bleaching solutions, there can be used methods described in *Foundation of Photographic Engineering-Silver Salt Photography Part,* (edited by Nihon Shashin Gakkai, published by Corona 1979) in addition to the above-described aeration. Specifically, examples of methods for regenerating the bleaching solutions include, but are not limited to, a regeneration method using electrolysis; and methods using bromic acid, chlorous acid, bromine, bromine precursors, persulfates, hydrogen peroxide, hydrogen peroxide in the presence of a catalyst, bromous acid or ozone. In the regeneration method by electrolysis, a cathode and an anode are placed in the same bleaching bath, or an anode bath and a cathode bath are separated from each other through a separator. In addition thereto, the bleaching solution and the developing solution and/or the fixing solution can be simultaneously regenerated by using a separator.

In the present invention, silver can be recovered from the fixing solutions and/or the blixing solutions by conventional methods. The regenerated solutions from which silver has been recovered can be reused. Silver recovering methods which can be effectively used include an electrolysis method (described in French Patent 2,299,667), a precipitation method described in JP-A-52-73037, West German Patent 2,331,220), an ion exchange method (described in JP-A-51-17114, West German Patent 2,548,237) and a metal displacement method (described in U.K. Patent 1,353,805). These silver recovering methods are preferred because rapid processability becomes much better when silver recovery is conducted in the tank solutions through an in-line procedure.

It is preferred that the bleaching solutions and/or the blixing solutions are intensely stirred in the processing of the present invention. The stirring methods described in JP-A-3-33847 (the 6th line of right upper column of page 8 to the second line of left lower column of page 8) can be used as such. Among them, there is preferred a jet stirring system wherein the bleaching solutions are allowed to collide with the emulsion surface of the light-sensitive material.

The sum total of the total processing time of the desilverization stage comprising a combination of the bleaching stage, the blixing stage and the fixing stage is preferably 30 seconds to 3 minutes, more preferably 45 seconds to 2 minutes. The processing temperature of the desilverization stage is 3° to 60° C., preferably 40° to 55° C.

After the processing stage conducted by using the fixing solution and/or the blixing solution, a rinsing stage is usually carried out. After processing with the processing solutions having an ability of fixing, there can be used a simple processing method wherein a stabilization treatment is carried out by using a stabilizing solution without substantially rinsing.

Rinsing water used in the rinsing stage and the stabilizing solution used in the stabilization stage may contain various surfactants to prevent water spots from being formed during the course of the drying of the light-sensitive material after processing. Nonionic surfactants are preferred, and alkylphenol ethylene oxide adducts are particularly preferred. Preferred examples of the alkylphenol include octylphenol, nonylphenol, dodecylphenol and dinonylphenol. Moles of ethylene oxide to be added are preferably 8 to 14. It is also preferred that silicone surfactants having a high anti-foaming effect are used.

Rinsing water and the stabilizing solution may contain antibacterial agents and antifungal agents to prevent scale from forming or to prevent mold from being grown in the light-sensitive material after processing. Further, it is preferred that rinsing water and the stabilizing solution contain chelating agents. Preferred examples of the chelating agents include aminopolycarboxylic acids such as ethylenediaminetetraacetic acid and diethylenetriaminepentaacetic acid, organic phosphonic acids such as 1-hydroxyethylidene-1,1-diphosphonic acid, ethylenediaminetetraacetic acid and diethylenetriamine-N,N,N',N'-tetramethylenephosphonic acid, and hydrolyzates of maleic anhydride polymers described in EP 345,172A1. Further, it is preferred that rinsing water and the stabilizing solution contain preservatives which can be contained in the fixing solutions and the blixing solutions.

Examples of the stabilizing solution which can be used in the stabilization stage include processing solutions for stabilizing a dye image, such as organic acids, solutions having a buffer capacity at a pH of 3 to 6 and solutions containing an aldehyde (e.g., formalin or glutaraldehyde). The stabilizing solution can contain all of the compounds which can be added to rinsing water. If desired, the stabilizing solution may optionally contain ammonium compounds such as ammonium chloride and ammonium sulfite, compounds of metals such as Bi and Al, fluorescent brighteners, hardening agents and alkanolamines described in U.S. Pat. No. 4,786,583.

In the present invention, it is preferred that the stabilizing solution is substantially free from formaldehyde as a stabilizer for dye image. The term "substantially free from formaldehyde" as used herein means that the sum total of free formaldehyde and its hydrate is not more than 0.003 mol per liter of the stabilizing solution.

When such a stabilizing solution as mentioned above is used, the scattering of formaldehyde vapor during processing can be inhibited. In this case, it is preferred that a substitute for formaldehyde is allowed to exist in the stabilizing solution or in the bleaching solution or a prebath (e.g., compensating bath) thereof to stabilize a magenta dye.

Examples of compounds which can be preferably used as a substitute for formaldehyde include hexamethylenetetramine and derivatives thereof, formaldehyde bisulfite adducts, N-methylol compounds and azolylmethylamine compounds. These preferred compounds have an effect of preventing yellow stain from being formed with time in addition to the effect of stabilizing a magenta dye.

Hexamethylenetetramine and derivatives thereof which can be used in the present invention include compounds described in *Beilstains Handbuch der Organishen Chemie,* the 11th enlarged edition, Vol. 26, pp. 200–212. Hexamethylenetetramine is particularly preferred. Formaldehyde sodium bisulfite adduct is preferred as the formaldehyde bisulfite adduct.

Preferred examples of the N-methylol compounds include N-methylol compounds of pyrazole and derivatives thereof, N-methylol compounds of triazole and derivatives thereof and N-methylol compounds of urazol and derivatives thereof.

Specific examples of these N-methylol compounds include 1-hydroxymethylpyrazole, 1-hydroxymethyl-2-methylpyrazole, 1-hydroxymethyl-2,4-dimethylpyrazole, 1-hydroxymethyl-1,2,4-triazole and 1-hydroxymethylurazol. Among them, 1-hydroxymethylpyrazole and 1-hydroxymethyl-1,2,4-triazole are particularly preferred.

The above N-methylol compounds can be easily synthesized by reacting an amine compound having no methylol group with formaldehyde or paraformaldehyde.

It is preferred that when the above N-methylol compounds are used, an amine compound having no methylol group is allowed to coexist in the processing solution. The amine compound is used in an amount of 2 to 10 times by mol the concentration of the N-methylol compound.

Examples of the azolylmethylamine compounds include 1,4-bis(1,2,4-triazol-1-ylmethyl)piperazine and 1,4-bis(pyrazol-1-ylmethyl)piperazine- It is particularly preferred that these compounds are used together with an azole such as 1,2,4-triazole or a pyrazole (as described in EP 519190A2) because image stability is high and the pressure of formaldehyde vapor is low.

The above compounds used as a substitute for formaldehyde are used in an amount of 0.003 to 0.2 mol, preferably 0.005 to 0.05 mol per liter of the processing solution.

These compounds may be used as a mixture of two or more of them in a bath.

The stabilizing solution has a pH of preferably 6 to 9, more preferably 6.5 to 8.2.

It is preferred that the rinsing stage and the stabilization stage are carried out by a multi-stage countercurrent system. The number of stages is preferably 2 to 4.

The replenishment rate per unit area is 1 to 50 times, preferably 1 to 30 times, more preferably 1 to 10 times the amount of the solution brought over from the prebath.

The disclosure of JP-A-3-33847 (the 9th line of right lower column of page 11 to the 19th line of right upper column of page 12) can be preferably applied to the rinsing stage and the stabilization stage of the present invention.

Tap water can be used as water used in the rinsing stage and the stabilization stage. However, it is preferred that there is used water obtained by deionizing tap water with an ion exchange resin to reduce the concentration of each of Ca ion and Mg ion to not higher than 5 mg/l, or water sterilized by halogen or ultraviolet light sterilizing lamp.

It is also preferred that the overflow solution from the rinsing stage or the stabilization stage is allowed to flow into a bath having an ability of fixing which is a prebath because the amount of waste water thereby can be reduced.

It is preferred that the various baths are replenished with an appropriate amount of water, a correcting solution or a processing replenisher in the processing of the present invention to thereby correct the compositions of the processing solutions concentrated by evaporation. Preferred methods for the replenishment of water include, but are not limited to, a method wherein a monitor water bath is separately provided in addition to the bleaching bath, the evaporated amount of water in the monitor water bath is determined, the evaporated amount of water in the bleaching bath is calculated from the evaporated amount of water in the monitor water bath, and the bleaching bath is replenished with water in proportion to the evaporated amount as described in JP-A-1-254959 and JP-A-1-254960; and a method wherein the evaporated amount is corrected by using a liquid level sensor or an overflow sensor as described in U.S. Pat. No. 5,124,239, JP-A-3-248155, 3-249645, 3-249646, 4-14042. Tap water may be used to correct the evaporated amount of water in each processing solution. However, deionized water preferably used in the rinsing stage or sterilized water is preferable.

Light-sensitive materials which can be used in the present invention are those having at least one silver halide emulsion layer containing silver iodide. The Silver halide to be contained in the emulsion layer is preferably silver iodochloride, silver iodochlorobromide or silver iodobromide, each having a silver iodide content of 1 to 30 mol %. More preferably, the silver halide is silver iodochlorobromide or silver iodobromide, each having a silver iodide content of 2 to 20 mol %. Examples of these silver halides include those described in JP-A-3-144446 (the second line of right lower column of page 13 to the 14th line of left lower column of page 18).

The present invention is now illustrated in greater detail by reference to the following examples which, however, are not to be construed as limiting the present invention in any way.

EXAMPLE 1

The following layers having the following compositions were coated on an undercoated cellulose triacetate film support to prepare a multi-layer color light-sensitive material as Sample 101.

Composition of Light-Sensitive Layer

Following abbreviations for principal ingredients used in the following layers are used for brevity's sake.

ExC: cyan coupler
ExM: magenta coupler
ExY: yellow coupler
ExS: sensitizing dye
UV: ultraviolet light absorber
HBS: high-boiling organic solvent
H: hardening agent for gelatin Numerals represent coating weight (g/m$^2$). The amount of silver halide emulsion is represented by coating weight in terms of silver. The amount of sensitizing dye is represented by moles per one mole of silver halide in the same layer.

| Sample 101 | |
|---|---|
| **First layer (antihalation layer)** | |
| Black colloidal silver (in terms of silver) | 0.18 |
| Gelatin | 1.40 |
| ExM-1 | 0.18 |
| ExF-1 | $2.0 \times 10^{-3}$ |
| HBS-1 | 0.20 |
| **Second layer (interlayer)** | |
| Emulsion G (in terms of silver) | 0.065 |
| 2,5-Di-t-pentadecylhydroquinone | 0.18 |
| ExC-2 | 0.020 |
| UV-1 | 0.060 |
| UV-2 | 0.080 |
| UV-3 | 0.10 |
| HBS-1 | 0.10 |
| HBS-2 | 0.020 |
| Gelatin | 1.04 |
| **Third layer (low-sensitivity red-sensitive emulsion layer)** | |
| Emulsion A (in terms of silver) | 0.25 |
| Emulsion B (in terms of silver) | 0.25 |
| ExS-1 | $6.9 \times 10^{-5}$ |
| ExS-2 | $1.8 \times 10^{-5}$ |
| ExS-3 | $3.1 \times 10^{-4}$ |
| ExC-1 | 0.17 |
| ExC-3 | 0.030 |
| ExC-4 | 0.10 |
| ExC-5 | 0.020 |
| ExC-7 | 0.0050 |
| ExC-8 | 0.010 |
| Cpd-2 | 0.025 |
| HBS-1 | 0.10 |
| Gelatin | 0.87 |
| **Fourth layer (intermediate-sensitivity red-sensitive emulsion layer)** | |
| Emulsion D (in terms of silver) | 0.70 |
| ExS-1 | $3.5 \times 10^{-4}$ |
| ExS-2 | $1.6 \times 10^{-5}$ |
| ExS-3 | $5.1 \times 10^{-4}$ |
| ExC-1 | 0.13 |
| ExC-2 | 0.060 |
| ExC-3 | 0.0070 |
| ExC-4 | 0.090 |
| ExC-5 | 0.025 |
| ExC-7 | 0.0010 |
| ExC-8 | 0.0070 |
| Cpd-2 | 0.023 |
| HBS-1 | 0.10 |
| Gelatin | 0.75 |
| **Fifth layer (high-sensitivity red-sensitive emulsion layer)** | |
| Emulsion E (in terms of silver) | 1.40 |
| ExS-1 | $2.4 \times 10^{-4}$ |
| ExS-2 | $1.0 \times 10^{-4}$ |
| ExS-3 | $3.4 \times 10^{-4}$ |
| ExC-1 | 0.12 |
| ExC-3 | 0.045 |
| ExC-6 | 0.020 |
| ExC-8 | 0.025 |
| Cpd-2 | 0.050 |
| HBS-1 | 0.22 |
| HBS-2 | 0.10 |

-continued

| Sample 101 | |
|---|---|
| Gelatin | 1.20 |
| **Sixth layer (interlayer)** | |
| Cpd-1 | 0.10 |
| HBS-1 | 0.50 |
| Gelatin | 1.10 |
| **Seventh layer (low-sensitivity green-sensitive emulsion layer)** | |
| Emulsion C (in terms of silver) | 0.35 |
| ExS-4 | $3.0 \times 10^{-5}$ |
| ExS-5 | $2.1 \times 10^{-4}$ |
| ExS-6 | $8.0 \times 10^{-4}$ |
| ExM-1 | 0.010 |
| ExM-2 | 0.33 |
| ExM-3 | 0.086 |
| ExY-1 | 0.015 |
| HBS-1 | 0.30 |
| HBS-3 | 0.010 |
| Gelatin | 0.73 |
| **Eighth layer (intermediate-sensitivity green-sensitive emulsion layer)** | |
| Emulsion D (in terms of silver) | 0.80 |
| ExS-4 | $3.2 \times 10^{-5}$ |
| ExS-5 | $2.2 \times 10^{-4}$ |
| ExS-6 | $8.4 \times 10^{-4}$ |
| ExM-2 | 0.13 |
| ExM-3 | 0.030 |
| ExY-1 | 0.018 |
| HBS-1 | 0.16 |
| HBS-3 | $8.0 \times 10^{-3}$ |
| Gelatin | 0.90 |
| **Ninth layer (high-sensitivity green-sensitive emulsion layer)** | |
| Emulsion E (in terms of silver) | 1.25 |
| ExS-4 | $3.7 \times 10^{-5}$ |
| ExS-5 | $8.1 \times 10^{-5}$ |
| ExS-6 | $3.2 \times 10^{-4}$ |
| ExC-1 | 0.010 |
| ExM-1 | 0.030 |
| ExM-4 | 0.040 |
| ExM-5 | 0.019 |
| Cpd-3 | 0.040 |
| HBS-1 | 0.25 |
| HBS-2 | 0.10 |
| Gelatin | 1.44 |
| **Tenth layer (yellow filter layer)** | |
| Yellow colloidal silver (in terms of silver) | 0.030 |
| Cpd-1 | 0.16 |
| HBS-1 | 0.60 |
| Gelatin | 0.60 |
| **Eleventh layer (low-sensitivity blue-sensitive emulsion layer)** | |
| Emulsion C (in terms of silver) | 0.18 |
| ExS-7 | $8.6 \times 10^{-4}$ |
| ExY-1 | 0.020 |
| ExY-2 | 0.22 |
| ExY-3 | 0.50 |
| ExY-4 | 0.020 |

-continued

| Sample 101 | |
|---|---|
| HBS-1 | 0.28 |
| Gelatin | 1.10 |
| **Twelfth layer (intermediate-sensitivity blue-sensitive emulsion layer)** | |
| Emulsion D (in terms of silver) | 0.40 |
| ExS-7 | $7.4 \times 10^{-4}$ |
| ExC-7 | $7.0 \times 10^{-3}$ |
| ExY-2 | 0.050 |
| ExY-3 | 0.10 |
| HBS-1 | 0.050 |
| Gelatin | 0.78 |
| **Thirteenth layer (high-sensitivity blue-sensitive emulsion layer)** | |
| Emulsion F (in terms of silver) | 1.00 |
| ExS-7 | $4.0 \times 10^{-4}$ |
| ExY-2 | 0.10 |
| ExY-3 | 0.10 |
| HBS-1 | 0.070 |
| Gelatin | 0.86 |
| **Fourteenth layer (first protective layer)** | |
| Emulsion G (in terms of silver) | 0.20 |
| UV-4 | 0.11 |
| UV-5 | 0.17 |
| HBS-1 | $5.0 \times 10^{-2}$ |
| Gelatin | 1.00 |
| **Fifteenth layer (second protective layer)** | |
| H-1 | 0.40 |
| B-1 (diameter: 1.7 μm) | $5.0 \times 10^{-2}$ |
| B-2 (diameter: 1.7 μm) | 0.10 |
| B-3 | 0.10 |
| S-1 | 0.20 |
| Gelatin | 1.20 |

Further, each layer contained W-1 to W-3, B-4 to B-6, F-1 to F-17, iron salt, lead salt, gold salt, platinum salt, iridium salt and rhodium salt to improve preservability, processability, pressure resistance, anti-fungal and antibacterial properties, antistatic properties and coatability.

TABLE 1

| Emulsion | Average AgI Content (%) | Mean Grain Size (μm) | Coefficient of variation in the Grain Size (%) | Ratio of Diameter/Thickness | Ratio of amount of silver [Core/Intermediate/Shell] (AgI Content) | Grain Structure/Form |
|---|---|---|---|---|---|---|
| A | 4.0 | 0.45 | 27 | 1 | [1/3] (13/1) | Double structural octahedral grains |
| B | 8.9 | 0.70 | 14 | 1 | [3/7] (25/2) | Double structural octahedral grains |
| C | 2.0 | 0.55 | 25 | 7 | — | Uniform structural tabular grains |
| D | 9.0 | 0.65 | 25 | 6 | [12/59/29] (0/11/8) | Triple structural tabular grains |
| E | 9.0 | 0.85 | 23 | 5 | [8/59/33] (0/11/8) | Triple structural tabular grains |
| F | 14.5 | 1.25 | 25 | 3 | [37/63] (34/3) | Double structural platy grains |
| G | 1.0 | 0.07 | 15 | 1 | — | Uniform structural fine grains |

In Table 1, (1) Emulsions A to F were reduction-sensitized during the preparation of grains by using thiourea dioxide and thiosulfonic acid according to Examples of JP-A-2-191938.

(2) Emulsions A to F were subjected to gold sensitization, sulfur sensitization and selenium sensitization in the presence of sodium thiocyanate and spectral sensitizing dyes described in each light-sensitive layer according to Examples of JP-A-3-237450.

(3) Tabular grains were prepared by using low-molecular gelatin according to Examples of JP-A-1-158426.
(4) Tabular grains and normal crystal grains having a grain structure showed that dislocation lines as described in JP-A-3-237450 were observed through high-pressure electron microscope.
ExC-1
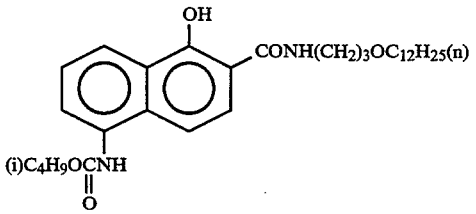
ExC-2
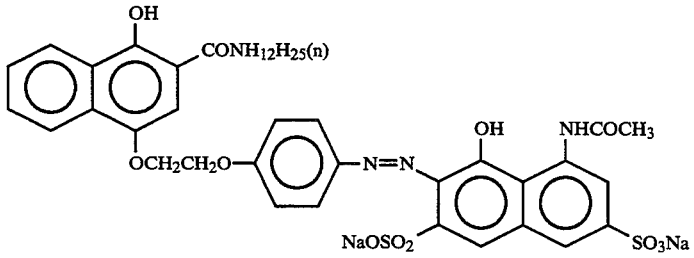
ExC-3
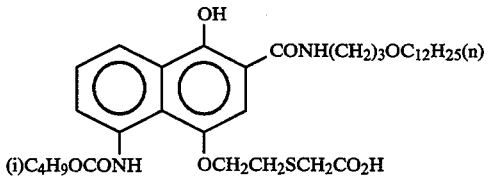
ExC-4
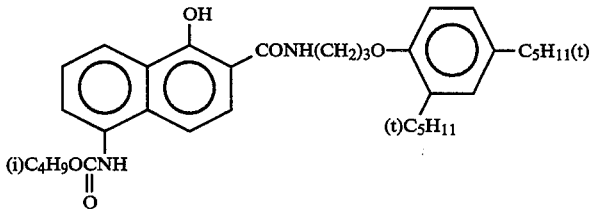
ExC-5
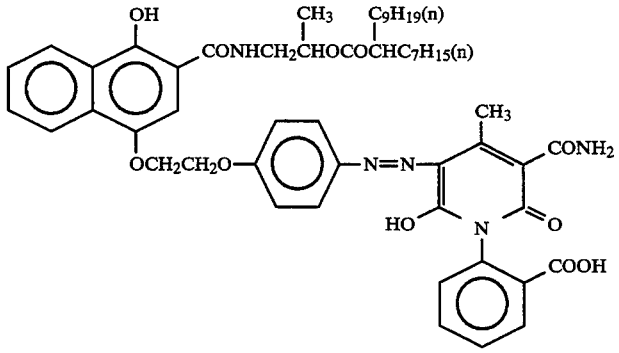
ExC-6
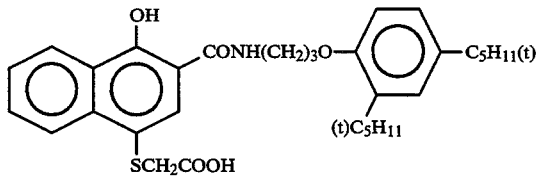

-continued
ExC-7
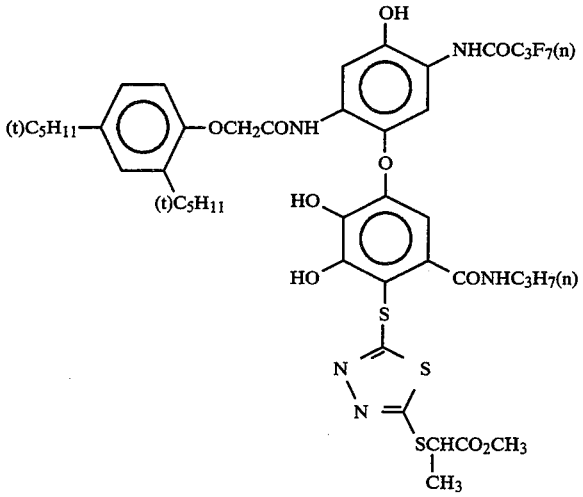
ExC-8
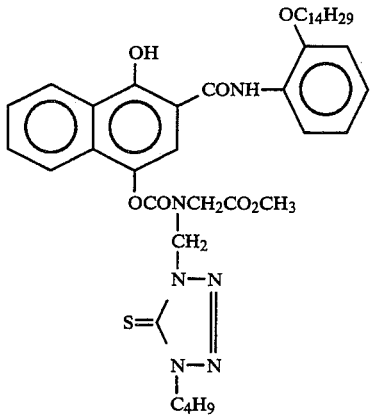
ExM-1
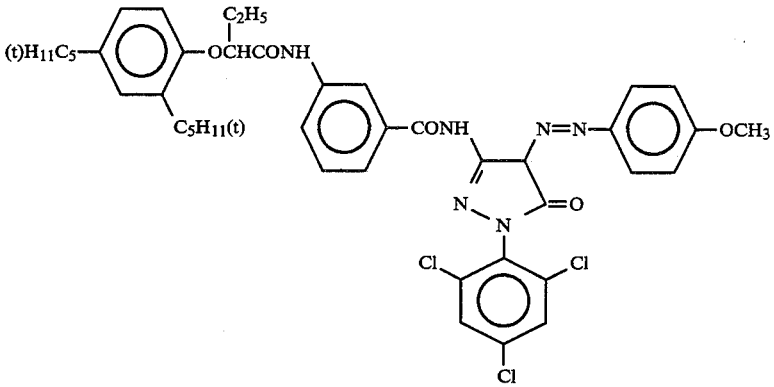
ExM-2
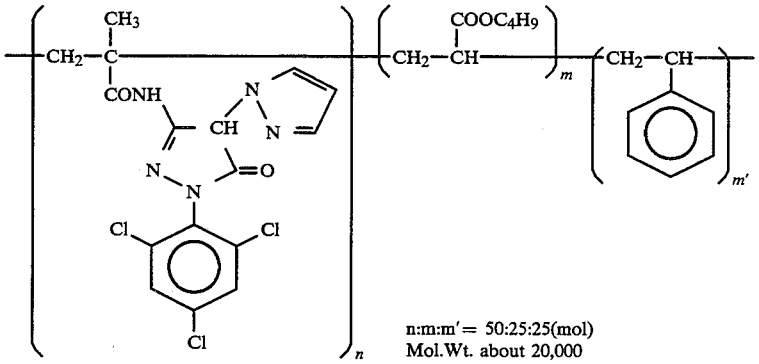
n:m:m' = 50:25:25(mol)
Mol.Wt. about 20,000
ExM-3
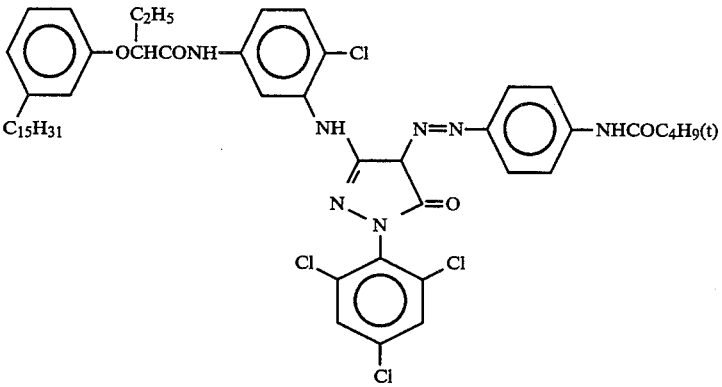

-continued
ExM-4
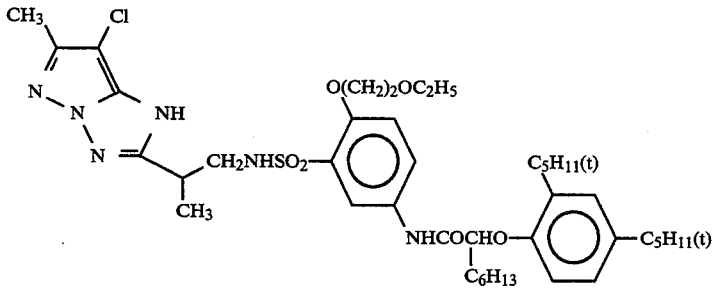
ExM-5
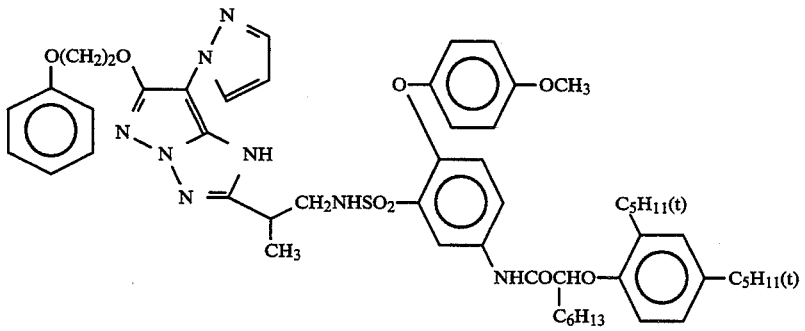
ExY-1
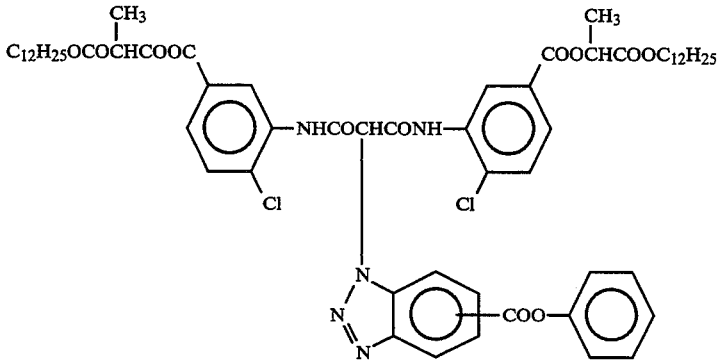
ExY-2
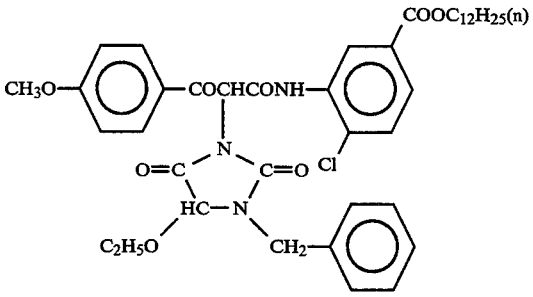
ExY-3
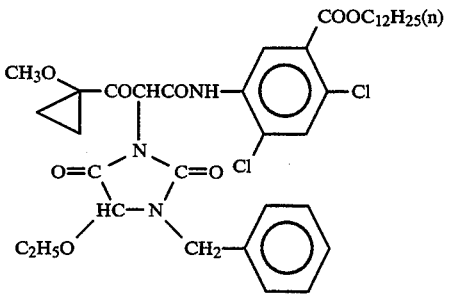
ExY-4
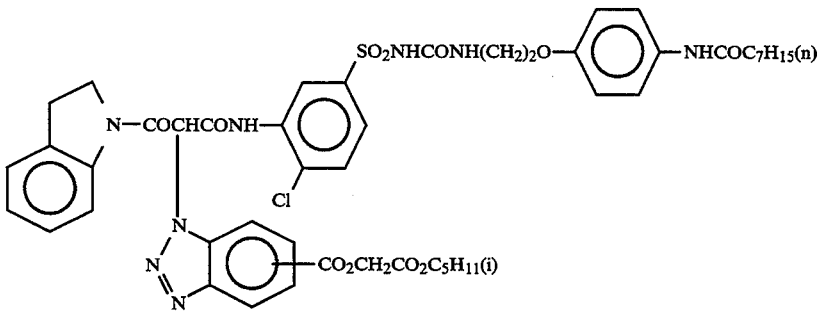

-continued
ExF-1
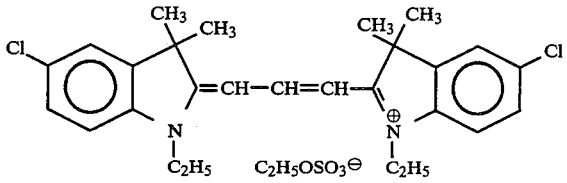
Cpd-1
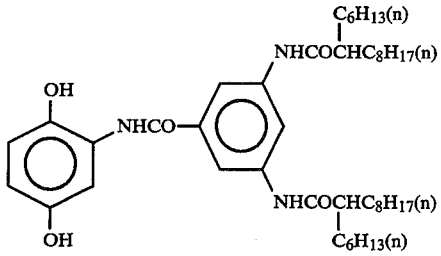
Cpd-2
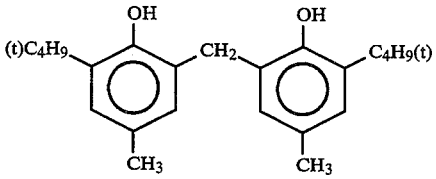
Cpd-3
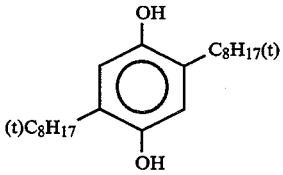
UV-1
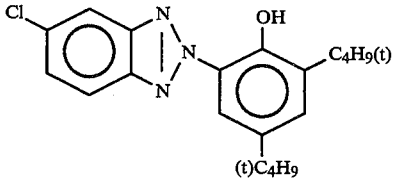
UV-2
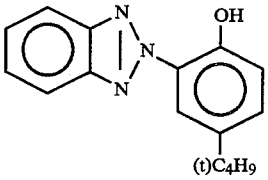
UV-3
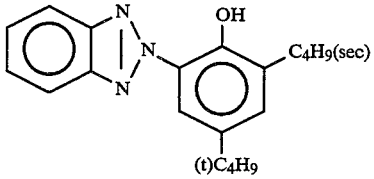
UV-4
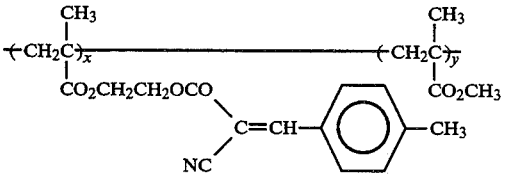
x:Y: = 70:30(wt%)
UV-5
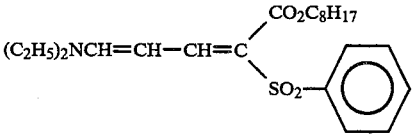
Tricresyl phosphate HBS-1
Di-n-butyl phtalate HBS-2
HBS-3
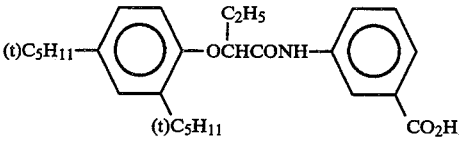
ExS-1
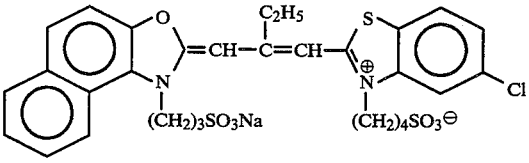
ExS-2
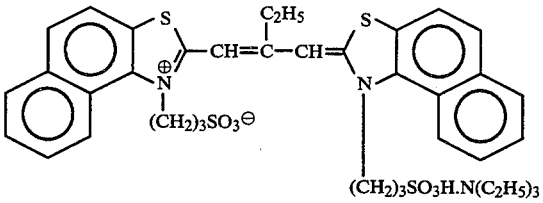

-continued
ExS-3
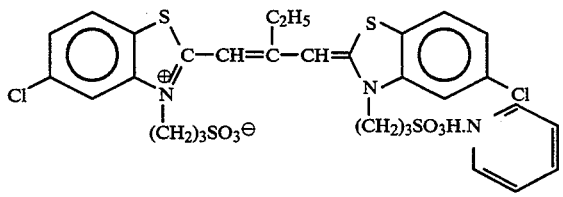
ExS-4
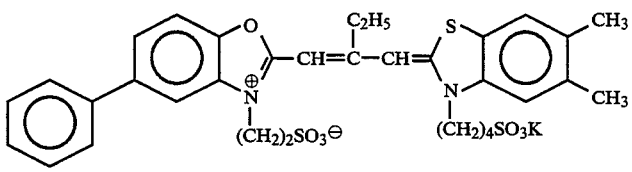
ExS-5
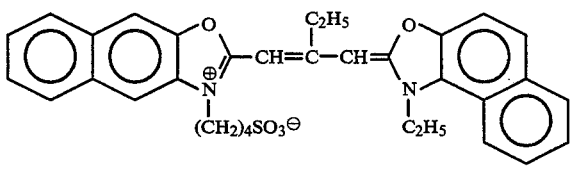
ExS-6
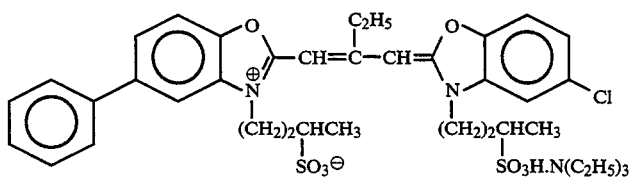
ExS-7
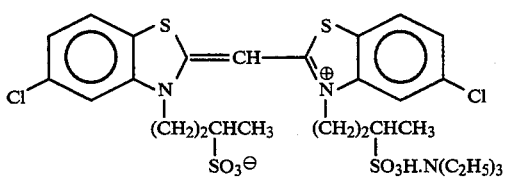
S-1
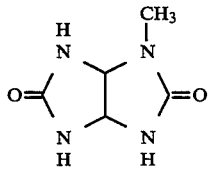
H-1
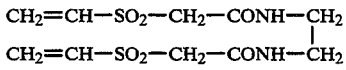
B-1
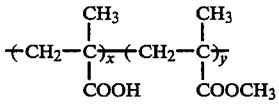
x/y = 10/90 (mol)
B-2
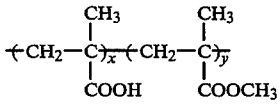
x/y = 40/60 (mol)
B-3
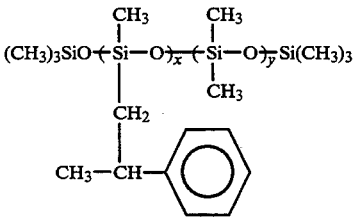
x/y = 29/46 (mol)
B-4
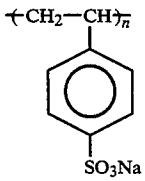
Mol. Wt. 50,000 to 3,000,000

-continued
B-5
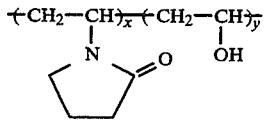
x/y = 70/30 (mol)
B-6
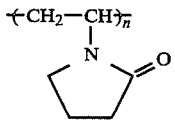
(mol. wt. about 10,000)
W-1
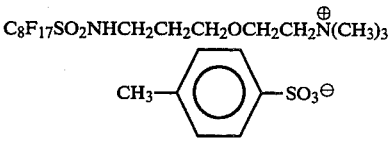
W-2
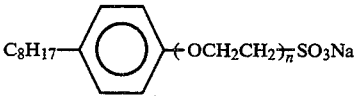
n = 2~4
W-3
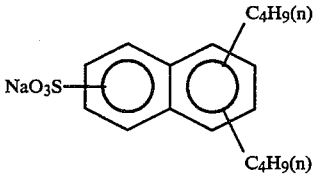
F-1
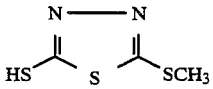
F-2
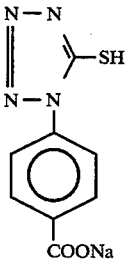
F-3
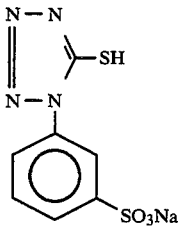
F-4
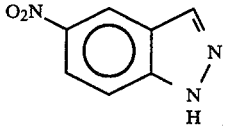
F-5
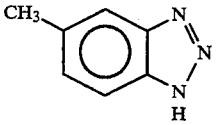
F-6
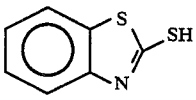
F-7
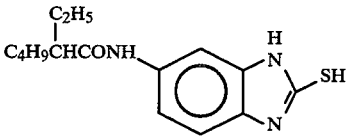
F-8
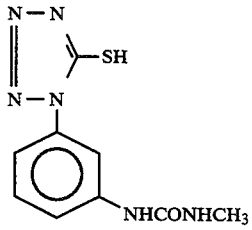
F-9
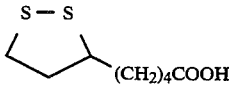
F-10
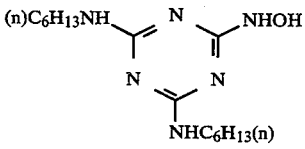
F-11
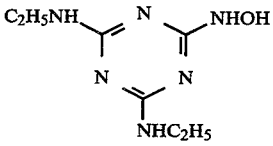
F-12
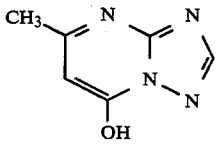
F-13
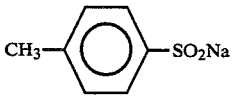

-continued

F-14

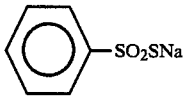

F-15

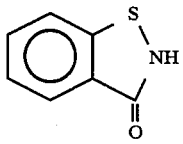

F-16

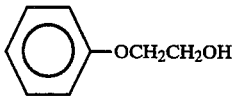

F-17

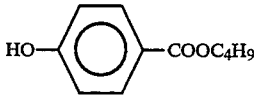

Sample 101 was exposed to light through a continuous gradation wedge by using a blue filter (exposure amount: 5 CMS), and then processed in the following processing stages in the following manner.

| Stage | Processing Stage: Processing time | Processing temp. (°C.) |
|---|---|---|
| Color development | 60 sec | Indicated in Table 2 |
| Bleaching | 30 sec | 45 |
| Fixing (1) | 30 sec | 45 |
| Fixing (2) | 30 sec | 45 |
| Stabilization (1) | 20 sec | 40 |
| Stabilization (2) | 20 sec | 40 |
| Stabilization (3) | 20 sec | 40 |
| Drying | 1 min | 60 |

Each processing solution had the following composition.

| | Amount (g) |
|---|---|
| Color developing solution | |
| Diethylenetriamine pentaacetic acid | 2.0 |
| 1-Hydroxyethylidene-1,1-diphosphonic acid | 3.3 |
| Sodium sulfite | 4.0 |
| Potassium carbonate | 37.5 |
| Potassium bromide | Indicated in Table 2 |
| Potassium iodide | 1.3 mg |
| Hydroxylamine sulfate | 2.4 |
| 2-Methyl-4-[N-ethyl-N-(β-hydroxyethyl)amino]aniline sulfate | Indicated in Table 2 |
| Add water to make | 1.0 liter |
| pH | 10.05 |
| Bleaching solution | |
| Ammonium 1,3-diaminopropanetetraacetate ferrate monohydrate | 130 |
| Ammonium bromide | 80 |
| Ammonium nitrate | 15 |
| Hydroxyacetic acid | 50 |
| Acetic acid | 40 |
| Add water to make | 1.0 liter |
| pH (adjusted with ammonia water) | 4.2 |

-continued

| | Amount (g) |
|---|---|
| Fixing solution | |
| Ammonium sulfite | 19 |
| Aqueous solution of ammonium thiosulfate (700 g/l) | 280 ml |
| Ethylene diaminetetraacetic acid | 15 |
| Imidazole | 15 |
| Add water to make | 1.0 liter |
| pH (adjusted with ammonia water and acetic acid) | 7.4 |
| Stabilizing solution | |
| Sodium p-toluenesulfinate | 0.03 |
| Polyoxyethylene p-monononylphenyl ether (an average degree of polymerization: 10) | 0.2 |
| Disodium ethylenediaminetetraacetate | 0.05 |
| 1,2,4-Triazole | 1.3 |
| 1,4-Bis(1,2,4-triazole-1-ylmethyl)-piperazine | 0.75 |
| Add water to make | 1.0 liter |
| pH (adjusted with ammonia water and hydrochloric acid) | 8.5 |

As reference processing, processing was carried out by standard processing wherein the processing time of color development was $3\frac{1}{4}$ minutes, the processing temperature was 38° C., the concentration of KBr in the color developing solution was 11.8 mmol/l, and the concentration of the developing agent was 16 mmol/l.

After processing, $S/N=(S_{0.2}/YD_{min})$ was calculated from the logarithm value ($S_{0.2}$) of an exposure amount giving a density of (Fog+0.2) and the fog density of yellow ($YD_{min}$). The value of $YD_{min}$ in standard processing was 0.7, and $S_{0.2}$ was −2.4.

Photographic performance was evaluated by $\Delta YD_{min}$, $\Delta S_{0.2}$ and $\Delta S/N$ wherein $\Delta YD_{min}$=a difference in the fog density of yellow between the above standard processing and other processing; $\Delta S_{0.2}$=a difference in $S_{0.2}$ therebetween; and $\Delta S/N$=a value obtained by dividing S/N value in other processing by S/N value in standard processing. The results are shown in Table 2.

TABLE 2

| No. | Potassium bromide (mmol/l) | [Rule] Range of concentration of developing agent ±16 (mmol/l) | [Rule] Temperature range ±5 (°C.) | Concentration of developing agent (mmol/l) | Processing temperature (°C.) | $\Delta YD_{min}$ | $\Delta S_{0.2}$ | $\Delta S/N$ | Remarks |
|---|---|---|---|---|---|---|---|---|---|
| 1 | 12.6 | — | — | 20 | 45 | −0.10 | −0.39 | 0.98 | Comp. Ex. |
| 2 | 12.6 | — | — | 30 | 42 | −0.10 | −0.39 | 0.98 | Comp. Ex. |
| 3 | 12.6 | — | — | 40 | 40 | −0.09 | −0.38 | 0.97 | Comp. Ex. |
| 4 | 32 | about 34.1 | about 45.0 | 15 | 52 | +0.15 | ±0 | 0.82 | Comp. Ex. |
| 5 | 32 | about 34.1 | about 45.0 | 25 | 47 | +0.02 | ±0 | 0.97 | Invention |
| 6 | 32 | about 34.1 | about 45.0 | 35 | 44 | +0.01 | +0.01 | 0.99 | Invention |
| 7 | 32 | about 34.1 | about 45.0 | 55 | 38 | ±0 | −0.10 | 0.96 | Comp. Ex. |
| 8 | 42 | about 40.4 | about 46.9 | 23 | 55 | +0.16 | −0.01 | 0.81 | Comp. Ex. |
| 9 | 42 | about 40.4 | about 46.9 | 32 | 47 | +0.02 | +0.01 | 0.98 | Invention |
| 10 | 42 | about 40.4 | about 46.9 | 42 | 44 | +0.01 | +0.02 | 0.99 | Invention |

TABLE 2-continued

| No. | Potassium bromide (mmol/l) | [Rule] Range of concentration of developing agent ±16 (mmol/l) | [Rule] Temperature range ±5 (°C.) | Concentration of developing agent (mmol/l) | Processing temperature (°C.) | $\Delta YD_{min}$ | $\Delta S_{0.2}$ | ΔS/N | Remarks |
|---|---|---|---|---|---|---|---|---|---|
| 11 | 42 | about 40.4 | about 46.9 | 58 | 40 | +0.01 | −0.09 | 0.95 | Comp. Ex. |
| 12 | 58 | about 50.5 | about 50.0 | 33 | 57 | +0.10 | −0.02 | 0.87 | Comp. Ex. |
| 13 | 58 | about 50.5 | about 50.0 | 42 | 53 | +0.01 | +0.03 | 1.00 | Invention |
| 14 | 58 | about 50.5 | about 50.0 | 52 | 49 | ±0 | +0.05 | 1.02 | Invention |
| 15 | 58 | about 50.5 | about 50.0 | 68 | 43 | +0 | −0.18 | 0.93 | Comp. Ex. |
| 16 | 87 | about 68.8 | about 55.5 | 50 | 62 | +0.12 | −0.05 | 0.84 | Comp. Ex. |
| 17 | 87 | about 68.8 | about 55.5 | 63 | 57 | +0.05 | −0.12 | 0.89 | Comp. Ex. |
| 18 | 87 | about 68.8 | about 55.5 | 74 | 53 | +0.03 | −0.17 | 0.89 | Comp. Ex. |
| 19 | 87 | about 68.8 | about 55.5 | 86 | 52 | +0.02 | −0.35 | 0.83 | Comp. Ex. |
| 20 | 58 | about 50.5 | about 50.0 | 33 | 53 | −0.01 | −0.12 | 0.96 | Comp. Ex. |
| 21 | 58 | about 50.5 | about 50.0 | 33 | 49 | −0.12 | −0.40 | 0.71 | Comp. Ex. |
| 22 | 58 | about 50.5 | about 50.0 | 68 | 49 | +0.10 | +0.09 | 0.91 | Comp. Ex. |
| 23 | 58 | about 50.5 | about 50.0 | 68 | 53 | +0.58 | +0.23 | 0.60 | Comp. Ex. |

In Table 2, Nos. 1 to 3 show the relationship between the concentration of the developing agent to that of bromide ion and the processing temperature described in Examples of JP-A-63-136044. It can be seen from the results that sufficient sensitivity can not be obtained, though the fog density of yellow is low. Further, when the concentration of bromide ion is too high, sufficient sensitivity can not be obtained (see, Nos. 16 to 19). Furthermore, it can be seen that when the concentration of the developing agent is higher than that defined by the rule, sensitivity to fog density can not be obtained, and when the processing temperature is higher than that defined by the rule, fog density to sensitivity is high and S/N value becomes worse (see, Nos. 8, 11, 15, 4, 8, 12).

On the other hand, it can be seen that good photographic characteristics can be obtained when the concentration of the developing agent to that of bromide ion and the processing temperature are in the range defined by the rule. Further, it can be seen that when the concentration of bromide ion is in a more preferred range of 43 to 67 mmol/l, better results can be obtained.

| Color developing solution | Amount (g) |
|---|---|
| Ethylenediamine-N,N,N',N'-tetrakis-(methylenephosphonic acid) | 2.0 |
| Sodium sulfite | 4.0 |
| Potassium carbonate | 37.5 |
| Potassium bromide | Indicated in Table 3 |
| Potassium iodide | 1.3 mg |
| Hydroxylamine sulfate | 2.4 |
| 4-Amino-3-methyl-N-ethyl-N-(4-hydroxybutyl)aniline sulfate | Indicated in Table 3 |
| Compound (A-1) of formula (A) | Indicated in Table 3 |
| Add water to make | 1.0 liter |
| pH | 10.05 |

A difference ($\Delta MD_{min}$) in the fog density of magenta dye between the same standard processing as in Example 1 and other processing and a difference ($\Delta S_{0.2}$) in sensitivity therebetween were determined, and S/N value was calculated. The results are shown in Table 3.

TABLE 3

| No. | Potassium bromide (mmol/l) | [Rule] Range of concentration of developing agent ±16 (mmol/l) | [Rule] Range of temperature ±5 (°C.) | Concentration of developing agent (mmol/l) | Processing temperature (°C.) | Compound (A-1) (ppm) | $\Delta MD_{min}$ | $\Delta S_{0.2}$ | ΔS/N | Remarks |
|---|---|---|---|---|---|---|---|---|---|---|
| 1 | 35 | about 36.0 | about 45.6 | 18 | 52 | 0 | +0.19 | +0.02 | 0.85 | Comp. Ex. |
| 2 | 35 | about 36.0 | about 45.6 | 24 | 46 | 0 | +0.02 | +0.01 | 0.97 | Invention |
| 3 | 35 | about 36.0 | about 45.6 | 36 | 42 | 0 | +0.02 | +0.01 | 0.97 | Invention |
| 4 | 35 | about 36.0 | about 45.6 | 36 | 42 | 150 | −0.02 | ±0 | 1.04 | Invention |
| 5 | 35 | about 36.0 | about 45.6 | 55 | 38 | 0 | +0.01 | −0.10 | 0.94 | Comp. Ex. |
| 6 | 50 | about 45.5 | about 48.5 | 27 | 55 | 0 | +0.18 | −0.02 | 0.73 | Comp. Ex. |
| 7 | 50 | about 45.5 | about 48.5 | 27 | 55 | 50 | +0.18 | −0.05 | 0.72 | Comp. Ex. |
| 8 | 50 | about 45.5 | about 48.5 | 27 | 55 | 150 | +0.15 | −0.15 | 0.72 | Comp. Ex. |
| 9 | 50 | about 45.5 | about 48.5 | 27 | 55 | 250 | +0.12 | −0.22 | 0.73 | Comp. Ex. |
| 10 | 50 | about 45.5 | about 48.5 | 33 | 45 | 0 | +0.02 | +0.05 | 0.98 | Invention |
| 11 | 50 | about 45.5 | about 48.5 | 33 | 45 | 50 | +0.01 | ±0 | 0.98 | Invention |
| 12 | 50 | about 45.5 | about 48.5 | 33 | 45 | 150 | −0.01 | ±0 | 1.02 | Invention |
| 13 | 50 | about 45.5 | about 48.5 | 33 | 45 | 250 | −0.01 | ±0 | 1.02 | Invention |
| 14 | 50 | about 45.5 | about 48.5 | 63 | 41 | 0 | +0.02 | −0.15 | 0.90 | Comp. Ex. |
| 15 | 50 | about 45.5 | about 48.5 | 63 | 41 | 150 | ±0 | −0.22 | 0.91 | Comp. Ex. |

EXAMPLE 2

Sample 101 prepared in Example 1 was subjected to grey exposure (5 CMS) through a continuous gradation wedge, and then processed with the processing solutions in the same manner as in Example 1, except that the following color developing solution was used.

It can be seen from Table 3 that when the compound of general formula (A) is used, photographic characteristics, particularly S/N value can be more improved, though the effect of the compound of general formula (A) is not clear when the range of the concentration of the developing agent and the range of the processing temperature are outside the scope of the present invention. Further, it can be seen that the compound is effective when the compound is used in an amount of not less than 100 ppm (see, Nos. 8, 9, 12, 13).

EXAMPLE 103

Sample 101 prepared in Example 1 was processed in the following manner.

| Stage | Processing Stage: Processing time | Processing Stage: Processing temperature |
|---|---|---|
| Color development | Indicated in Table 4 | Indicated in Table 4 |
| Bleaching | 50 sec | 38.0° C. |
| Bleaching-fixing | 50 sec | 38.0° C. |
| Fixing | 50 sec | 38.0° C. |
| Rinse | 30 sec | 38.0° C. |
| Stabilization (1) | 20 sec | 38.0° C. |
| Stabilization (2) | 20 sec | 38.0° C. |
| Drying | 1 min | 60° C. |

Each processing solution had the following composition.

| | Amount (g) |
|---|---|
| Color developing solution | |
| Diethylenetriaminepentaacetic acid | 2.0 |
| 1-Hydroxyethylidene-1,1-diphosphonic acid | 3.3 |
| Potassium carbonate | 37.5 |
| Potassium bromide | Indicated in Table 4 |
| Potassium iodide | 1.3 mg |
| Hydroxylamine sulfate | 2.4 |
| Sodium sulfite | 4.5 |
| Color developing agent [compound of formula (D)] | Indicated in Table 4 |
| Compound (A-1) | 0.3 |
| Water to make | 1.0 liter |
| pH | 10.25 |
| Bleaching solution | |
| Bleaching agent [iron(III) complex salt of H-1] (indicated in Table 4) | 90 mmol |
| Ammonium bromide | 84.0 |
| Ammonium nitrate | 17.5 |
| Hydroxyacetic acid | 63.0 |
| Acetic acid | 54.2 |
| Water to make | 1.0 liter |
| pH (adjusted with ammonia water) | 3.80 |

Blixing Solution

A 15:85 (volume) mixed solution of the above bleaching solution (mother solution) and the fixing solution (mother solution) described below.

| Fixing solution | Amount (g) |
|---|---|
| Ammonium sulfite | 19.0 |
| Aqueous solution of ammonium thiosulfate (700 g/l) | 280 ml |
| Imidazole | 28.5 |
| Ethylenediaminetetraacetic acid | 12.5 |
| Water to make | 1.0 liter |
| pH (adjusted with ammonia water and acetic acid) | 7.40 |

Rinsing Water

Tap water was passed through a mixed bed column packed with an H type strongly acidic cation exchange resin (Amberlite IR-120B manufactured by Rohm & Haas Co.) and an OH type strongly basic anion exchange resin (Amberlite IRA-400) to reduce the concentration of each of calcium ion and magnesium ion to not higher than 3 mg/l. Subsequently, sodium dichlorinated isocyanurate (20 mg/l) and sodium sulfate (150 mg/l) were added thereto. The pH of the solution was in the range of 6.5 to 7.5.

| Stabilizing solution | Amount (g) |
|---|---|
| Formalin (37%) | 1.2 ml |
| Sodium p-toluenesulfinate | 0.3 g |
| Polyoxyethylene p-monononylphenyl ether (an average degree of polymerization: 10) | 0.2 |
| Disodium ethylenediaminetetraacetate | 0.05 |
| Water to make | 1.0 liter |
| pH | 7.2 |

Sample 101 was subjected to gradation exposure and processed.

Each of the yellow and magenta density of the thus-obtained sample was measured to obtain a characteristic curve. The minimum density (Dmin) of yellow was read from the characteristic curve, and the logarithm value of the reciprocal of an exposure amount giving a magenta density of (Dmin +0.2) was referred to as sensitivity (S).

In Table 4, color development of No. 1 is not rapidly conducted, and No. 1 is standard processing, Only No. 1 contains the developing agent at a concentration of 16 mmol/l. The color developing solutions in the processing of No. 2 and subsequent Nos. contain the developing agent at a concentration of 45 mmol/l. The color developing solutions in the processing of Nos. 12, 13 and 14 do not contain the compound of general formula (A). The sensitivity and minimum density are represented by a difference (ΔS, ΔDmin) when No. 1 is referred as standard.

It can be seen from the results of No. 1 and No. 2 that when processing temperature is outside the scope of the present invention, sufficient sensitivity cannot be obtained, and when the concentration of KBr is low, Dmin is raised. Further, it can be seen that when the concentration of KBr and the processing temperature are outside the scope of the present invention, Dmin is raised even when the color developing agent of the present invention is used (No. 5).

On the other hand, it is apparent that according to the present invention, fogging scarcely occurs, a lowering in sensitivity is scarcely caused and hence good results can be obtained even when rapid processing is carried out.

However, when the compound of general formula (A) is omitted, Dmin is relatively high and good results cannot be obtained in comparison with the case where the compound of general formula (A) is used (Nos. 12, 13 and 14).

TABLE 4

| | Color developing agent (45 mmol/l) | Potassium bromide (g/l) | Color development processing time | Processing temperature (°C.) | A difference in sensitivity ΔS magenta | ΔDmin yellow | Remarks |
|---|---|---|---|---|---|---|---|
| 1 | a (16 mmol/l) | 1.4 | 3 min 15 sec | 38 | standard | standard | Comp. Ex. |
| 2 | a* | 6.0 | 1 min 15 sec | 42 | −0.11 | −0.09 | Comp. Ex. |
| 3 | a* | 6.0 | 1 min 15 sec | 45 | −0.03 | +0.02 | Invention |

TABLE 4-continued

| | Color developing agent (45 mmol/l) | Potassium bromide (g/l) | Color development processing time | Processing temperature (°C.) | A difference in sensitivity ΔS magenta | ΔDmin yellow | Remarks |
|---|---|---|---|---|---|---|---|
| 4 | b** | 6.0 | 1 min 15 sec | 45 | −0.04 | +0.02 | Invention |
| 5 | D-1 | 1.4 | 3 min 15 sec | 38 | +0.07 | +0.08 | Comp. Ex. |
| 6 | D-1 | 6.0 | 1 min 15 sec | 45 | ±0 | ±0 | Invention |
| 7 | D-2 | 6.0 | 1 min 15 sec | 45 | +0.01 | +0.01 | Invention |
| 8 | D-3 | 6.0 | 1 min 15 sec | 45 | −0.01 | ±0 | Invention |
| 9 | D-4 | 6.0 | 1 min 15 sec | 45 | +0.01 | +0.01 | Invention |
| 10 | D-5 | 6.0 | 1 min 15 sec | 45 | +0.01 | +0.01 | Invention |
| 11 | D-6 | 6.0 | 1 min 15 sec | 45 | ±0 | +0.02 | Invention |
| 12 | D-1 | 6.0 | 1 min 15 sec | 45 | +0.01 | +0.02 | Compound of formula (A) was omitted Invention |
| 13 | D-2 | 6.0 | 1 min 15 sec | 45 | +0.02 | +0.03 | Compound of formula (A) was omitted Invention |
| 14 | D-3 | 6.0 | 1 min 15 sec | 45 | +0.02 | +0.03 | Compound of formula (A) was omitted Invention |

*a 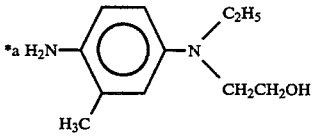
(242 mV)

**b 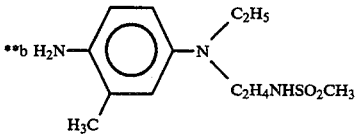
(247 mV)

Bleaching Agent H-1 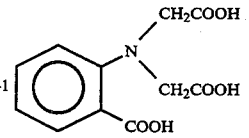

It will be understood from the above disclosure that according to the present invention, rapid color development processing can be carried out with good results with regard to fog density, sensitivity and S/N ratio.

While the invention has been described in detail and with reference to specific embodiments thereof, it will be apparent to one skilled in the art that various changes and modifications can be made therein without departing from the spirit and scope thereof.

What is claimed is:

1. A color development process for processing an imagewise exposed silver halide color photographic material comprising a support having thereon at least one light-sensitive silver halide emulsion layer comprising a color coupler and a silver iodobromide emulsion containing silver iodide in an amount of from 2 to 20 mol %, comprising the step of processing the color photographic material in a color developing solution containing a color developing agent and bromide ion for 40 seconds to 90 seconds, wherein the color developing agent is represented by formula (D'):

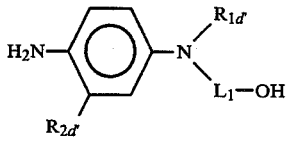
(D')

where $R_{1d}$, $R_{2d}$, each represents an alkyl group having 1 to 4 carbon atoms; and $L_1$ represents a straight-chain or branched alkylene group having 3 or 4 carbon atoms;

the concentration {Br−} of bromide ion in the color developing solution is from 30 to 60 mmol/l;

the relationship between the concentration {R} of the color developing agent in the color developing solution and the concentration {Br−} of bromide ion in the color developing solution and the relationship between the development processing temperature Tem and the concentration {Br−} of bromide ion are maintained to satisfy a Rule defined by the following equations:

(Rule)

$$\{R\}=((0.63\times\{Br^-\})+(14))\pm 16 \text{ (mmol/l)}$$

$$Tem=((0.19\times\{Br^-\})+(39))\pm 5 \text{ (°C.)}$$

where {R} is the concentration of color developing agent in units of mmol/l;

{Br−} is the concentration of bromide ion in units of mmol/l; and

Tem is the development processing temperature in °C.

2. A color development process as in claim 1, wherein the concentration {Br−} of bromide ion in the color developing solution is from 43 to 60 mmol/l.

3. A color development process as in claim 1, wherein the development time is 45 seconds to 60 seconds.

4. A color development process as in claim 1, wherein said color developing solution contains at least 0.1 g/l of one or more compounds represented by the following general formula (A):

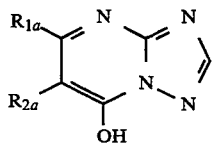

(A)

wherein $R_{1a}$ represents a methyl group, an ethyl group or a propyl group; and $R_{2a}$ represents a hydrogen atom; or $R_{1a}$ and $R_{2a}$ together form a five-membered or six-membered ring through an group.

5. A color development process as in claim 4, wherein the color developing solution contains 0.1 to 0.8 g/l of the compound represented by formula (A).

6. A color development process as in claim 1, wherein said color developing solution contains at least one compound represented by formula (E):

$$L_{1e}—(A_{1e}—L_{2e})_r—A_{2e}—L_{3e} \quad (E)$$

wherein $L_{1e}$ and $L_{3e}$, which may be the same or different, each represents an alkyl group having 1 to 4 carbon atoms substituted by $—OM_{e1}$, $—SO_3M_{1e}$, $—PO_3M_{2e}M_{3e}$ or $COOM_{e1}$; $L_{e2}$ represents an alkylene group, an arylene group, an aralkylene group, a heterocyclic group or a connecting group composed of these groups in combination; $A_{1e}$ and $A_{2e}$ each represent —S—; r represents an integer of 1 to 3; when r is 2 or more the individual $(A_{1e}—L_{2e})$ units may be the same or different; $M_{1e}$, $M_{2e}$ and $M_{3e}$, which may be the same or different, each represents a hydrogen atom or a counter cation.

7. A color development process as in claim 6, wherein the color developing solution contains the compound of formula (E) in an amount of $1\times10^{-6}$ to $1\times10^{-1}$ mol/l.

* * * * *